US007474981B2

(12) United States Patent
Goldman

(10) Patent No.: US 7,474,981 B2
(45) Date of Patent: Jan. 6, 2009

(54) METHOD AND DEVICE FOR PREDICTING RISK OF DECOMPRESSION SICKNESS

(76) Inventor: Saul Goldman, 133 Suffolk Street West, Guelph, Ontario (CA) N1H 2J6

( * ) Notice: Subject to any disclaimer, the term of this patent is extended or adjusted under 35 U.S.C. 154(b) by 226 days.

(21) Appl. No.: 11/369,470

(22) Filed: Mar. 7, 2006

(65) Prior Publication Data

US 2007/0213964 A1 Sep. 13, 2007

(51) Int. Cl.
*G01L 7/00* (2006.01)
*G06F 15/00* (2006.01)

(52) U.S. Cl. ..... 702/138; 73/865.1; 702/139

(58) Field of Classification Search ..... 702/23, 702/138, 139, 166; 73/865.1; 128/200.24, 128/201.27, 204.29, 205.23; 424/9.52; 514/743
See application file for complete search history.

(56) References Cited

U.S. PATENT DOCUMENTS

| | | | | |
|---|---|---|---|---|
| 4,192,001 | A | 3/1980 | Villa | |
| 4,835,371 | A | 5/1989 | Rogers | |
| 5,363,298 | A * | 11/1994 | Survanshi et al. | 73/865.1 |
| 5,570,688 | A | 11/1996 | Cochran | |
| 6,321,177 | B1 | 11/2001 | Ferrero | |
| 6,904,382 | B2 | 6/2005 | Hayafune | |
| 2003/0056786 | A1 | 3/2003 | Hollis | |
| 2003/0220762 | A1 | 11/2003 | Furuta | |
| 2005/0004711 | A1 | 1/2005 | Hirose | |

OTHER PUBLICATIONS

Ball et al., "Predicting risk of decompression sickness in humans from outcomes in sheep", Journal of Applied Physiology, 1999, pp. 1920-1929, vol. 86.

Butler et al., "The U.S. Navy decompression computer", Undersea Hyperb. Med., 2001 Fall, pp. 213-228, vol. 28.

Doolette et al., "Biophysical basis for inner ear decompression sickness." Journal of Applied Physiology, 2003, pp. 2145-2150, vol. 94.

Gilliam, "Evaluation of Decompression Sickness . . . ", in Repetitive Diving Workshop, 1992, pp. 15-24, AAUSDSP, USA.

Hamilton et al., "Decompression Practice", in Physiology and Medicine of Diving, 5th ed. 2003, Chapter 10.2, pp. 453-498, W.B. Saunders, Philadelphia.

Hamilton et al. "Development and validation of no-stop decompression procedures . . . ", Feb. 28, 1994, pp. B1, B2, C1-C4 DSAT Inc. and Hamilton Research Ltd.

(Continued)

*Primary Examiner*—John H Le
(74) *Attorney, Agent, or Firm*—Clark & Elbing LLP

(57) ABSTRACT

A mathematical model that models gas exchange of a central compartment with an environment having a model gas is provided. The central compartment is modeled to be in direct fluid communication with a plurality of peripheral compartments and with the environment to exchange the model gas therewith. Using a measure of an inert gas in a breathing mixture over a period of exposure of a person to the breathing mixture as a measure of the model gas in the environment over the time period, a measure of the model gas in the central compartment can be calculated according to the model. A risk of decompression sickness to the person resulting from the exposure can then be calculated based on the calculated measure of the model gas in the central compartment.

46 Claims, 23 Drawing Sheets

OTHER PUBLICATIONS

Hills, "The Variation in Susceptibility to Decompression Sickness," International Journal of Biometeorology, 1968, pp. 343-349, vol. 12.

Jacquez, Compartmental Analysis in Biology and Medicine (2nd ed.) 1985, pp. 23-28, 38-54, 422, 491-492, The University of Michigan Press, Ann Arbor.

Klotz, Chemical Thermodynamics, 1964, pp. 335-338, 348-358, W. A. Benjamin Inc., New York.

Lillo et al., "Using animal data to improve prediction of human decompression risk following air-saturation dives," J. of Applied Physiology, (2002), pp. 216-226, vol. 93.

Morales et al., "A Note on the Physiological Arrangement of Tissues." Bulletin of Mathematical Biophysics, 1945, pp. 47-51, vol. 7.

Nishi et. al., "Bubble Detection" in Physiology and Medicine of Diving, 5th ed., 2003, pp. 501-529, W. B. Saunders, Philadelphia.

Novotny et al., "Xenon kinetics in muscle are not explained by a model of parallel perfusion-limited compartments", Journal of Applied Physiology, 1990, pp. 876-890, vol. 68.

Press et al., Numerical Recipes, the Art of Scientific Computing, 1989, pp. 246-247, Cambridge University Press, New York.

Rogers, "DSAT Dive Trials . . . ", in Repetitive Diving Workshop, 1992, pp. 299-309, AAUSDSP, USA.

Thalmann, Abstract of "Air Tables Revisited: Development of a Decompression Computer Algorithm," Undersea Biomed. Res., 1985b, suppl. p. 54, vol. 12.

Thalmann et al., "Improved probabilistic decompression model risk predictions using linear-exponential kinetics", Undersea Hyperbaric Medicine, 1997, pp. 255-274, vol. 24.

Tikuisis et al, "Use of the maximum likelihood method in the analysis of chamber air dives", Undersea Biomedical Research, 1988, pp. 301-313, vol. 15.

Tikuisis et al., "Decompression Theory" in Physiology And Medicine of Diving, 5th ed., 2003, pp. 419-454, W. B. Saunders, Philadelphia.

Vann, "Mechanisms and Risks of Decompression", in Diving Medicine, 2nd ed., 1990, pp. 29-49, Saunders, Philadelphia.

Weathersby,et al., "On the likelihood of decompression sickness", Journal of Applied Physiology, 1984, pp. 815-825, vol. 57.

Wienke, "Modern Decompression Algorithms: Models, Comparison and Statistics", downloaded online from http://www.dmscuba.com/Modern_Deco.pdf on Nov. 29, 2005.

Goldman, Saul, "A new class of biophysical models for predicting . . . scuba diving", Journal of Applied Physiology, 2007, pp. 484-493, A1-A11, B1-B8, and C1-C5, vol. 103.

* cited by examiner

METHOD AND DEVICE FOR PREDICTING RISK OF DECOMPRESSION SICKNESS

FIELD OF THE INVENTION

The present invention relates to methods and devices for predicting risk of decompression sickness, including dive computers.

BACKGROUND OF THE INVENTION

A person can suffer decompression sickness (DCS), also called decompression illness (DCI), if the person is exposed to a breathing gas with a pressure that decreases too quickly. DCS can be mild or severe and can have various neurological and audiovestibular manifestations and symptoms such as skin rash, pain, paralysis, blindness, and even death.

For instance, DCS can occur when a diver ascends to the water surface too quickly at the end of a dive. Both the depth and duration of the dive can influence the likelihood that DCS will occur. During a dive, a diver typically uses a breathing gas that contains oxygen and an inert gas such as nitrogen, with the total pressure of the breathing gas regulated to match the hydrostatic pressure at the current depth.

Some of the inert gas in the breathing gas can be absorbed by and dissolved in body tissues when the person is exposed to the breathing gas. The concentration of inert gas dissolved in a body tissue is dependent on the inert gas partial pressure in the breathing gas, referred to as the ambient inert gas partial pressure ($P_{a,n}$), and the length of exposure to the breathing gas. For a given $P_{a,n}$, the concentration of inert gas dissolved in the body tissue at equilibrium is referred to as the saturation concentration. The higher the $P_{a,n}$, the higher the saturation concentration. If, for a given $P_{a,n}$ (such as at a particular depth in a dive), the body tissue is under-saturated, i.e., having a lower dissolved inert gas concentration than the saturation concentration, more inert gas will be dissolved. On the other hand, if the body tissue is super-saturated, i.e., having a higher dissolved inert gas concentration than the saturation concentration, some of the dissolved inert gas will be released from the tissue.

For example, when a diver descends in water, $P_{a,n}$ and the saturation concentration increase; when the diver ascends, $P_{a,n}$ and the saturation concentration decrease. The period in a dive when the body tissues absorb inert gas is referred to as the "compression" phase of the dive. This typically includes the descent portion of the dive and the period when the diver is at the deepest depth prior to saturation. Saturation can be reached when the diver stays at a depth for a long period of time, or ascends from a deeper to a shallower depth. Super-saturation can also occur when the diver ascends. The period during or after a dive when the body tissues are super-saturated is referred to as the "decompression" phase. DCS can occur during the decompression phase. The rate at which inert gas is released from a body tissue at any given time during the decompression phase may depend on the difference between the values of the concentration of inert gas actually dissolved in the body tissue and the saturation concentration in that tissue at that time. The greater the difference, the faster the release rate. If the release rate is too fast, DCS can occur.

Therefore, it is important that divers follow safe dive profiles or decompression schedules to avoid DCS. In simple terms, a dive profile is a representation of the depth or ambient pressure ($P_a$), as a function of time during a dive. A dive profile can be presented in the form of a line graph, a chart, or a table. To avoid DCS, a diver can ascend continuously at a sufficiently slow rate. Alternatively, a diver can ascend relatively rapidly but in stages, pausing or stopping at each of one or more progressively shallower depth(s) for a certain time period during ascent (known as "decompression stops"). A further alternative is to start the ascent before a decompression stop becomes necessary (such a dive is known as a "no decompression" or "no-stop" dive). The maximum bottom time for a no-stop dive is referred to as the No Decompression Limit (NDL). The NDL can also be expressed as the remaining safe bottom time for a no-stop dive.

Dive tools, such as decompression tables, dive wheels, and dive computers, have been used to assist divers for preventing DCS. A diver can use a dive tool to determine the NDL during a dive, or, a safe decompression schedule if the NDL has been exceeded.

The NDL or the decompression schedules can be determined based on the risks of DCS for different dive profiles. The risk of DCS for a given dive can be assessed from $P_a$, $P_{a,n}$, and the concentrations of dissolved inert gas in various body tissues. The values of $P_a$ during a dive can be readily measured. The values of $P_{a,n}$ during a dive can be derived from $P_a$ for a given breathing gas. However, there is no practical and convenient way of measuring the concentrations of inert gas dissolved in various body tissues of the diver.

Therefore, conventionally, the risks of DCS are typically assessed based on decompression models. A conventional decompression model is a mathematical model with two distinct components. One component is a gas distribution model that describes the distribution of inert gas in the body tissues at all times. The other component is a risk function that relates the risk of DCS to the degree of inert gas supersaturation in the body tissues. Examples of decompression models include the Haldane model, the Reduced Gradient Bubble Model, the Varying Permeability Model, the Linear-Exponential model, and the like.

In conventional decompression models, such as the Haldanian models, the human body is represented as a number of parallel compartments (PC) each connected to the bloodstream. Each compartment exchanges gas with the bloodstream but is otherwise isolated from the other compartments. Each compartment has a characteristic tissue halftime and different compartments have different halftimes. For example, in the original Haldane model, there are five compartments with respective halftimes of 5, 10, 20, 40 and 75 minutes; a model used by the U.S. Navy (USN) has six compartments with respective halftimes of 5, 10, 20, 40, 80, and 120 minutes. In these models, the rate of gas uptake and release for each compartment is dependent on its halftime. For a given dive profile, the contribution to the risk of decompression sickness made by each compartment can be calculated. The overall risk at any given time takes into account contributions to the risk from all the compartments. For example, for a parallel N-compartment gas distribution model with a continuous risk function, the overall instantaneous risk r(t) at time t can be expressed as:

$$r(t) = \sum_{i=1}^{N} r_i(t), \tag{1}$$

where $r_i(t)$ is the instantaneous risk of decompression sickness, per unit time, for the ith compartment at time t. The total risk, which is related to the probability of DCS for the entire dive profile, can be assessed by taking into account r(t) over all the decompression components of the profile.

However, PC-based decompression models, on which many existing dive tools are based, have shortcomings. One problem is that these decompression models do not accurately represent the human body's actual response to decompression stress over a wide range of exposure profiles. Consequently, predictions derived from these models are inaccurate in many situations. A dive tool based on one of these models cannot provide good predictions for a wide range of dive profiles, and thus has limited application. A conventional dive tool may underestimate the risks of DCS for certain types of dive profiles and its users may unknowingly take unacceptable risks. To compensate for the inaccuracy of these models, some conventional dive tools such as dive computers use model parameters that are selected conservatively to avoid underestimating the risks of DCS for various types of dive profiles. As a result, for some types of dive profiles, these dive tools unnecessarily overestimate the risk. Therefore, divers, particularly recreational divers, who use these dive tools often have to shorten the bottom time or lengthen the stop time during ascent unnecessarily.

Accordingly, there is a need for methods and devices for predicting risks of DCS, which are based on decompression models that can provide a more accurate representation of the human body's response to decompression stress, or can provide satisfactory predictions over a wide range of exposure profiles.

SUMMARY OF THE INVENTION

A risk of decompression sickness to a person after exposure of the person to a breathing mixture comprising an inert gas can be calculated by modeling the exposure with a mathematical model that models gas exchange of a central compartment with an environment having the model gas. The central compartment is modeled to be in direct fluid communication with a plurality of peripheral compartments and with the environment to exchange the model gas therewith. The model gas can be used to model the inert gas and the compartments can be used to model body tissues of the person.

An aspect of the present invention is related to a method for predicting risks of decompression sickness. In this method, a mathematical model is provided, which models gas exchange of a central compartment with an environment having a model gas at a modeled environmental pressure ($P_e$). The central compartment is modeled to be in direct fluid communication with a plurality of peripheral compartments and with the environment to exchange the model gas therewith. The model comprises a plurality of prescribed parameters such that a pressure of the model gas in each compartment can be calculated using the model. For a period of exposure of a person to a breathing mixture comprising an inert gas, an ambient pressure ($P_a$) of the breathing mixture during the period is obtained. An ambient partial pressure ($P_{a,n}$) of the inert gas in the breathing mixture during the period is determined. The model is used, with $P_e=P_{a,n}$, to calculate a pressure ($P_{cc}$) of the model gas in the central compartment. A risk of decompression sickness to the person after exposure to the breathing mixture for the period is calculated from $P_a$, $P_{a,n}$ and $P_{cc}$. The values of the prescribed parameters are calibrated so that the calculated risk of decompression sickness is representative of actual risk of decompression sickness to the person after the exposure.

In other aspects of the present invention, a further method is provided which comprises receiving data indicative of a period of exposure of a person to a breathing mixture comprising an inert gas, and obtaining information derived from a risk of decompression sickness to the person after the period of exposure. The risk of decompression sickness is determined according to the method described in the preceding paragraph. A device may be provided which includes a tool for obtaining the information based on the data. The risk or the information, or both, may be retrievably pre-stored, in association with exposure data indicative of the exposure.

In accordance with a further aspect of the present invention, there is provided a computing device. The computing device comprises a processor and a memory storing computer executable instructions. The instructions, when executed by the processor, cause the processor to: for a period of exposure of a person to a breathing mixture comprising an inert gas, obtain an ambient pressure ($P_a$) of the breathing mixture during the period; determine an ambient partial pressure ($P_{a,n}$) of the inert gas in the breathing mixture during the period; calculate a pressure ($P_{cc}$), according to a mathematical model that models gas exchange of a central compartment with an environment having a model gas at a modeled environmental pressure ($P_e$), the central compartment modeled to be in direct fluid communication with a plurality of peripheral compartments and with the environment to exchange the model gas therewith, the model comprising a plurality of prescribed parameters such that a pressure of the model gas in each one of the compartments can be calculated using the model, wherein $P_{cc}$ is the pressure of the model gas in the central compartment and $P_e=P_{a,n}$; and calculate a risk of decompression sickness to the person after exposure to the breathing mixture for the period, from $P_a$, $P_{a,n}$ and $P_{cc}$, wherein values of the prescribed parameters are calibrated so that the risk of decompression sickness is representative of the actual risk of decompression sickness to the person after the period of exposure; and derive information related to decompression from the risk of decompression sickness. The computing device also comprises an output in communication with the processor for displaying the information related to decompression. The computing device may be a dive computer.

In accordance with yet another aspect of the present invention, there is provided a computer readable medium storing thereon the computer executable instructions described in the preceding paragraph.

A further aspect of the present invention is related to a method of predicting risks of decompression sickness of a person. In this method, a mathematical model is provided which models exchange of a model gas between a central compartment and the environment, said central compartment modeled to be in direct fluid communication with a plurality of peripheral compartments and with said environment to exchange said model gas therewith, said model allowing calculation of a measure of an amount of said model gas in said central compartment for a given measure of an amount of said model gas in said environment over a given time period; obtaining a measure of an amount of an inert gas in a breathing mixture over a period of exposure of said person to said breathing mixture; using, in said model, said measure of said amount of said inert gas over said period of exposure as said given measure of said amount of said model gas in said environment over said given time period, and calculating said measure of said amount of said model gas in said central compartment according to said model; and calculating a risk of decompression sickness to said person resulting from said exposure, based on said calculated measure of said amount of said model gas in said central compartment.

Other aspects and features of the present invention will become apparent to those of ordinary skill in the art upon review of the following description of specific embodiments of the invention in conjunction with the accompanying figures and tables.

BRIEF DESCRIPTION OF THE DRAWINGS

In the figures, which illustrate, by way of example only, embodiments of the present invention.

DETAILED DESCRIPTION

Figure 1A:
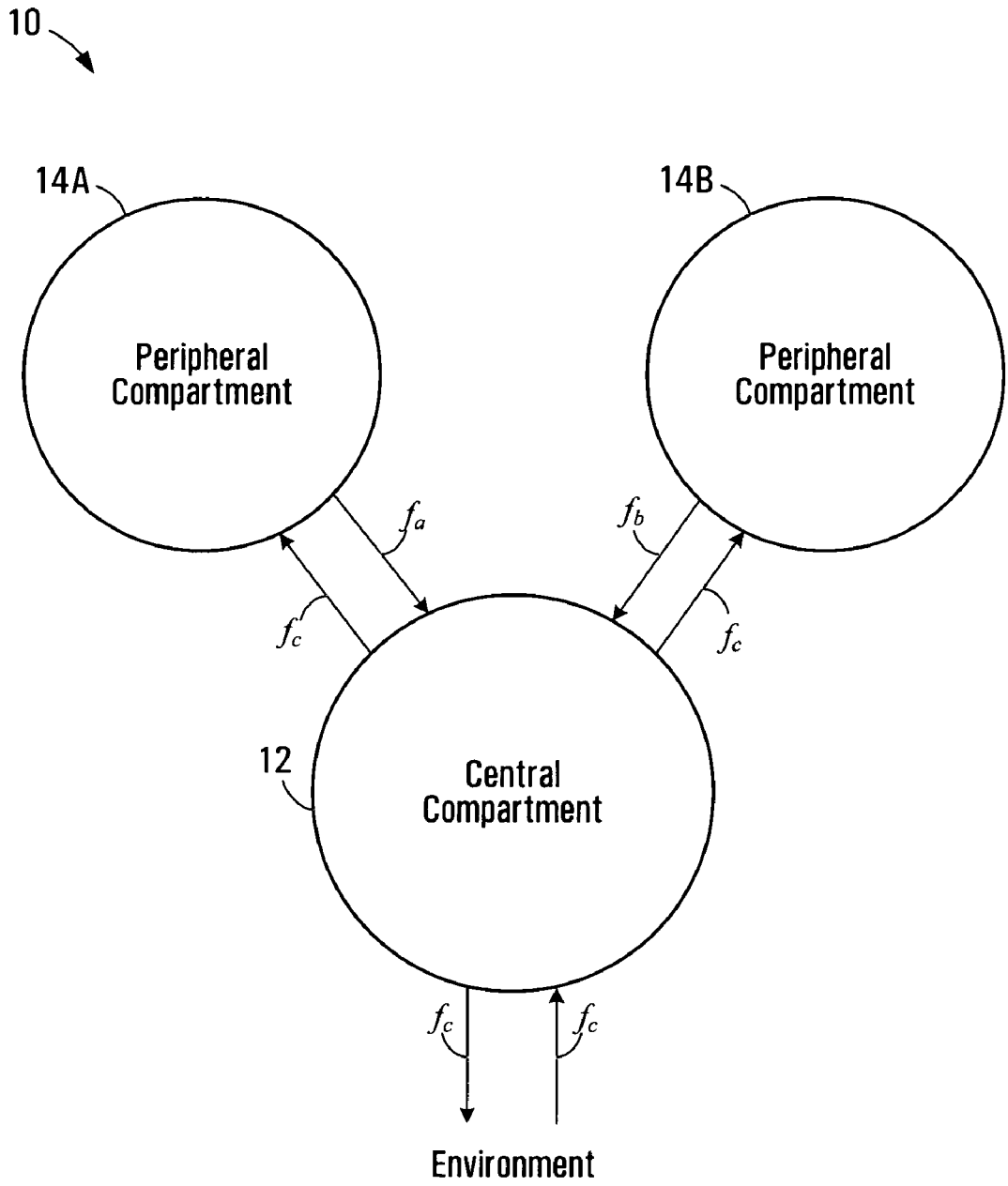
FIG. 1A is a schematic diagram of a compartmental mammillary system.

The inventor has discovered that risks of decompression sickness (DCS) can be predicted using a compartmental system or model, which has a central compartment and a plurality of peripheral compartments, where the central compartment exchanges gas directly with each peripheral compartment and with an environment. The risks of DCS may be assessed from a gas pressure, or another measure of an amount of the model gas, in the central compartment. The system is referred to herein as an interconnected-compartment (IC) system or model. It has been discovered that an IC model can predict risks of DCS more accurately than conventional models, such as parallel-compartment (PC) models, for a wide range of exposure profiles.

As used herein, an exposure profile refers to a representation of a user's exposure to a breathing mixture as a function of time. An exposure profile can be a dive profile. A dive profile is a representation or schedule of the depth (or the ambient pressure) and the breathing mixture as a function of time during one or more dives. A dive profile can be presented in the form of a line graph, a chart, or a table. There are different classes of dive profiles, including those described below.

A "bounce" dive refers to a dive in which the dive duration is too short to allow the diver's blood and all body tissues to become saturated with the inert gas(es) used in the breathing mixture at the deepest depth of the dive. In a bounce dive, some body tissues may be saturated during the ascent phase.

A "saturation" dive refers to a dive in which the diver stays at a particular depth for a sufficient duration to allow the diver's blood and body tissues to become saturated at that particular depth. Although many dive profiles may result in saturation for certain tissues, only the dives that have a long, relatively level bottom depth are considered as "saturation" dives. The bottom time required for a saturation dive depends on the depth, and the breathing mixture. It can be as long as more than six hours.

A "square" dive refers to a dive in which the diver descends directly to a particular depth, spends a period of time at that depth, and then ascends directly to the surface from that depth. A square dive can be a bounce dive or a saturation dive, depending on the time spent at the particular depth. A square dive is a no-stop dive.

A "multi-level" dive refers to a dive in which the diver spends significant time at each of two or more depths. For example, a dive with a decompression stop is a multi-level dive.

A "single" dive profile refers to a dive profile that has one dive which was neither preceded nor followed by another dive by a defined period of time (typically 24 hours).

A "repetitive" dive profile refers to a dive profile that includes at least two dives within a defined period of time (typically 24 hours).

In the literature, repetitive dives are sometimes treated as a "single" multi-level dive if the dives are within one day. To avoid confusion, it should be understood that, as used herein, a new "dive" always begins, and any previous dive ends, when a diver descends from the water surface to below the surface. A single dive profile, however, can include any number of dives, over any period of time. A dive profile can also refer to a portion of a dive, such as a decompression portion of the dive.

A "forward" dive profile refers to a repetitive dive profile in which a relatively short deep dive is followed by a longer shallower dive.

A "reverse" dive profile refers to a repetitive dive profile in which a relatively long shallow dive is followed by a shorter, deeper dive.

In an exemplary embodiment of the present invention, a mathematical model is provided which models gas exchange of a central compartment with an environment having a model gas at a modeled environmental pressure. The central compartment is modeled to be in direct fluid communication with a plurality of peripheral compartments and the environment to exchange the model gas therewith. A peripheral compartment is a compartment that is modeled to be in fluid communication with the central compartment, directly or indirectly through another compartment. The model includes a plurality of prescribed parameters such that a pressure of the model gas in each compartment can be calculated using the model. The central and peripheral compartments can form a compartmental mammillary (CM) system. In a mammillary system, only the central compartment directly transfers gas molecules to the environment. In some particular embodiments, the risk of DCS is calculated from a measure of an amount of the model gas in the central compartment. In other particular embodiments, the risk of DCS also includes a risk calculated from a measure of an amount of the model gas in one or some of the peripheral compartments.

The prescribed parameters can be respective fractional transfer coefficients for gas transfer from and to the central compartment. Values of the fractional transfer coefficients can be determined by calibration. The risks of DCS assessed using the model, in combination with a selected risk function, which will be described below, can be fitted to known data of risks of DCS for such a calibration. For example, the values of the fractional transfer coefficients can be determined by minimizing a selected statistical measure of the difference between measured risks of DCS and risks estimated by the model. Once the fractional transfer coefficients have been determined, the model may be used to assess risks of DCS for arbitrary exposure profiles, such as arbitrary dive profiles.

FIG. 1A illustrates an exemplary abstract 3-compartment mammillary (3CM) system 10, which can be used to model gas exchange between a human body and a breathing gas environment. As illustrated, system 10 includes three separate compartments: central compartment 12 and two peripheral compartments 14A and 14B (also individually and collectively referred to as 14 herein). As indicated by the arrows, central compartment 12 is assumed to exchange gas directly with each peripheral compartment 14 and the environment. Each peripheral compartment 14 exchanges gas directly with central compartment 12 only. As can be appreciated, peripheral compartments 14A and 14B can only exchange gas indirectly, through central compartment 12. In system 10, the volumes of the compartments 12, 14 and the temperature therein are assumed to be constant over time.

As illustrated in FIG. 1A, it may be assumed that gas transfer from a compartment to another directly connected compartment is proportional to the pressure in the originating compartment. To simplify the exemplary model, the fractional transfer coefficients for gas transfer from central compartment 12 to each of the peripheral compartments 14 are assumed to be the same, and denoted as $f_c$. The fractional transfer coefficients for gas transfer into central compartment 12 from peripheral compartments 14A and 14B are denoted as $f_a$ and $f_b$ respectively. To further simplify the scheme in FIG. 1A, the fractional transfer coefficients for gas transfer between the environment and central compartment 12 are also shown as to equal to $f_c$ in both directions. As discussed below, transfer from the environment to the central compartment can also be described in terms of an "input function". For ease of calculation, the fractional transfer coefficients are assumed to remain constant with time.

As will be understood by persons skilled in the art, with given values of $f_c$, $f_a$ and $f_b$, the gas kinetics of system 10 may be determined. For given initial conditions and given time-dependence of the environmental gas pressure, the gas pressure in each of compartments 12 and 14 at any given time can be determined accurately and rapidly, with explicit analytical expressions.

For example, the gas accumulation in central compartment 12 can be calculated in accordance with the known kinetics techniques of compartmental analysis, such as described in John A. Jacquez, *Compartmental analysis in biology and medicine,* 2nd ed., University of Michigan Press, 1985 ("Jacquez"), the contents of which are incorporated herein by reference. For example, the amount of gas accumulation in a central compartment in a mammillary system can be calculated accurately for given environmental and initial conditions with a given set of the fractional transfer coefficients. For simplicity, the term "pressure" is used herein to refer to the accumulation of gas, but it should be understood that the accumulation of gas can be expressed in terms of another physical quantity, such as density or concentration, which is indicative of the corresponding pressure. In other words, as used herein pressures can be expressed using other physical quantities that are indicative of pressures, such as densities or concentrations. As can be understood, gas densities, pressures, and concentrations can be readily converted from one to the other at given temperatures and can be therefore considered equivalent in terms of indicating the amount of gas accumulation within a fixed volume.

For convenience of calculation, it is assumed below that the compartments are "well-stirred" such that the gas molecules are always distributed uniformly within each compartment. It is also assumed that the temperature within the compartments is uniform, and that the volume of each compartment is constant with time. In different embodiments different assumptions may be made.

It may be shown that the gas pressures in the compartments 12 and 14 satisfy the following coupled differential rate equations:

$$dP_{cc}(t)/dt=f_c[P_{ca}(t)+P_{cb}(t)+P_e(t)-3P_{cc}(t)],$$

$$dP_{ca}(t)/dt=f_a[P_{cc}(t)-P_{ca}(t)],$$

$$dP_{cb}(t)/dt=f_b[P_{cc}(t)-P_{cb}(t)], \quad (2A)$$

where $P_{cc}$, $P_{ca}$ and $P_{cb}$ are respectively the modeled gas pressures in compartments 12, 14A and 14B, and $P_e$ is the modeled gas pressure in the model environment. As can be understood, these differential equations can be solved analytically in closed form so that for given initial conditions and parameters, the gas pressure in each of the compartments at any given time can be determined. The pressures may be determined accurately and rapidly for given conditions. The expressions for calculating the pressures can be readily derived by one skilled in the art. For example, the pressure in each compartment can be calculated in accordance with known kinetics techniques of compartmental analysis as, for example, described in Jacquez, supra.

As can be appreciated by persons skilled in the art, system 10 can be used to mathematically describe different physical or kinetic gas distribution models.

For example, system 10 may represent a simple gas distribution model, in which the compartments represent physical compartments that are filled with gas only. In this case, the pressures $P_{cc}$, $P_{ca}$ and $P_{cb}$ respectively represent the actual gas pressures in the compartments of the distribution model.

Figure 1B:
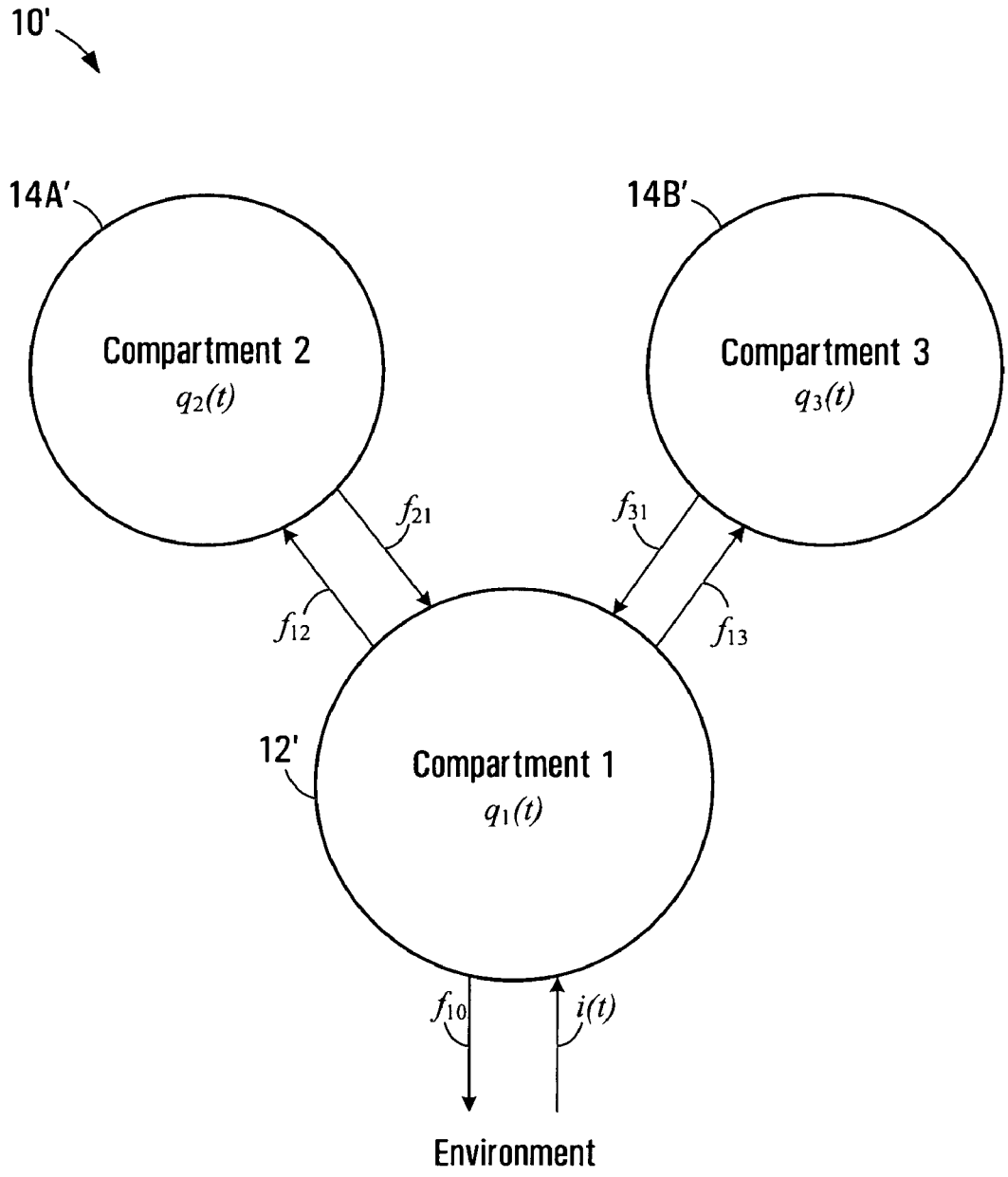
FIG. 1B is a schematic diagram of a compartmental mammillary system in which dissolved inert gas is distributed over the compartments.

System 10 may also represent a dissolved gas distribution model, such as model 10' shown in FIG. 1B, where compartments 12 and 14 respectively represent physical compartments, such as compartments 12' and 14' which contain body tissues represented by homogeneous solutions. The modeled gas represents an inert gas that, when transferred to compartments 12' or 14', will be dissolved in the solutions/tissues. In this case, the pressures $P_{cc}$, $P_{ca}$ and $P_{cb}$ do not represent actual gas pressures. Rather, they represent gas pressures for the dissolved inert gas molecules in the compartments. These dissolved gas pressures are also known as Henry's law-based pressures, as described, for example, in I. M. Klotz, *Chemical Thermodynamics*, W.A. Benjamin Inc., 1964, the contents of which are incorporated herein by reference. As can be appreciated, a dissolved gas distribution model may be a more realistic model for modeling inert gas distribution in human bodies.

As illustrated in FIG. 1B, model 10' includes three compartments 12', 14A' and 14B' (also collectively and individually referred to as 14' herein), which are in fluid communication, similar to that in system 10. Central compartment 12' is also in fluid communication with the environment in which there is an inert gas. As indicated, the rate of inert gas transfer from the environment to central compartment 12' is "i(t)", referred to as the "input function". The fractional transfer coefficient for inert gas transfer from compartment 12' to the environment is denoted as "$f_{10}$". The fractional transfer coefficient "$f_{ij}$" represents the fraction of material transferred out of the ith compartment, per unit time, and into the jth compartment (when j=1, 2 or 3, and j≠i) or the environment (when j=0). Of course, with a change in time units, a fractional quantity less than unity can become a quantity greater than unity. For example, $f_{10}=(2.09/60)\ sec^{-1}=2.09\ min^{-1}$. Fractional transfer coefficients are used herein for illustrative purposes only. Optionally, other equivalent measures or parameters may be used. For example, "rate constants" may be used instead of the fractional transfer coefficients. The conversion of fractional transfer coefficients to rate constants, and the relative merits of these measures, are discussed, for example, in Jacquez, supra.

If the total quantity of dissolved inert gas contained in a compartment "i" is denoted as "$q_i(t)$", it can be shown that $q_i(t)$'s satisfy the following coupled differential rate equations:

$$dq_1(t)/dt=-(f_{10}+f_{12}+f_{13})q_1(t)+f_{21}q_2(t)+f_{31}q_3(t)+i(t),$$

$$dq_2(t)/dt=f_{12}q_1(t)-f_{21}q_2(t),$$

$$dq_3(t)/dt=f_{13}q_1(t)-f_{31}q_3(t). \quad (2B)$$

When the $q_i(t)$'s can be determined, the rate Equations (2B) can be solved directly, such as discussed in Jacquez, supra. However, in cases where the $q_i(t)$'s cannot be conveniently determined, Equations (2B) may be transformed to pressure-based equations by using Henry's law and steady-state conditions. Assuming that the pressures $P_{cc}$, $P_{ca}$ and $P_{cb}$ are the Henry's law-based gas pressures for the dissolved inert gas in the respective compartments, and the pressure-based "input function" $i_p(t)=f_{10}P_e(t)$, Equations (2B) can be re-written as:

$$dP_{cc}(t)/dt=-(f_{10}+f_{12}+f_{13})P_{cc}(t)+f_{12}P_{ca}(t)+f_{13}P_{cb}(t)+f_{10}P_e(t),$$

$$dP_{ca}(t)/dt=f_{21}[P_{cc}(t)-P_{ca}(t)],$$

$$dP_{cb}(t)/dt=f_{31}[P_{cc}(t)-P_{cb}(t)]. \quad (2C)$$

Assuming $f_{10}=f_{12}=f_{13}=f_c$, $f_{21}=f_a$, and $f_{31}=f_b$, Equations (2C) then reduce to the same form as that of Equations (2A), and the solutions for Equations (2A) and (2C) have the same form as well. Thus, system 10 can represent model 10' in the sense that the gas pressures in the corresponding compartments (such as compartments 12 and 12') have the same time-dependence under the same environmental and initial conditions.

In alternative embodiments, systems 10 or 10' may be modified so that they have different numbers of compartments. A modified system may have one or more peripheral compartment(s) that also directly receive gas from, or exchange gas with, the environment or another peripheral compartment. The compartments may form an extended mammillary system, wherein, in addition to peripheral compartments that exchange gas directly with the central compartment, there is at least one peripheral compartment that exchanges gas indirectly with the central compartment through another peripheral compartment. The latter embodiment may be useful for modeling breathing mixtures containing Helium which, due to its large diffusion coefficient in tissues, may migrate to regions that are a considerable distance away from the tissue region modeled by the central compartment and its contiguous peripheral compartment(s).

Further, in different embodiments, it can also be assumed that the relationships among the fractional transfer coefficients are different from those assumed above for system 10 or model 10'. For example, it may be assumed that $f_{10}$, $f_{12}$ and $f_{13}$ have independent values, or that $f_{12}=f_{13}$ but these differ from $f_{10}$, and the like.

Conveniently, example system 10 of FIG. 1A is relatively simple and yet provides satisfactory results, as will be further discussed below. On the one hand, a system with fewer compartments, or fewer fluid communication channels such as fewer inputs or outputs, may not provide as accurate predictions. On the other hand, a system with more compartments, or more fluid communication channels such as additional inputs and outputs, is more complicated and may be difficult to treat analytically. Yet, a more complicated system may not lead to significant improvement over system 10 in terms of the accuracy of DCS risk predictions in many applications.

As will be further described below, system 10 with appropriately chosen values of $f_c$, $f_a$, and $f_b$ can be used, in combination with an appropriate risk function (as discussed below), to calculate risks of DCS. The values of $f_c$, $f_a$, and $f_b$, as well as any selected parameter(s) in the risk function (see below), can be chosen so that the risks of DCS calculated using system 10 are representative of actual risks of DCS. For example, the fractional transfer coefficients, as well as the risk function parameter(s), may be determined by calibration against measured, empirical data of DCS occurrence for selected types of dive profiles, or other empirical data directly or indirectly related to decompression sickness incidence rates. The empirical dive data may include human saturation data and the percentages of DCS instances for given types of dive profiles. Suitable conventional techniques for calibration of empirical mathematical models can be used. For different breathing mixtures, the prescribed parameters may have different values. For a given breathing mixture, it may be safer to use the parameters calibrated against corresponding empirical data for that breathing mixture, although in some cases one set of parameters may be suitable for different breathing mixtures.

Figure 2:
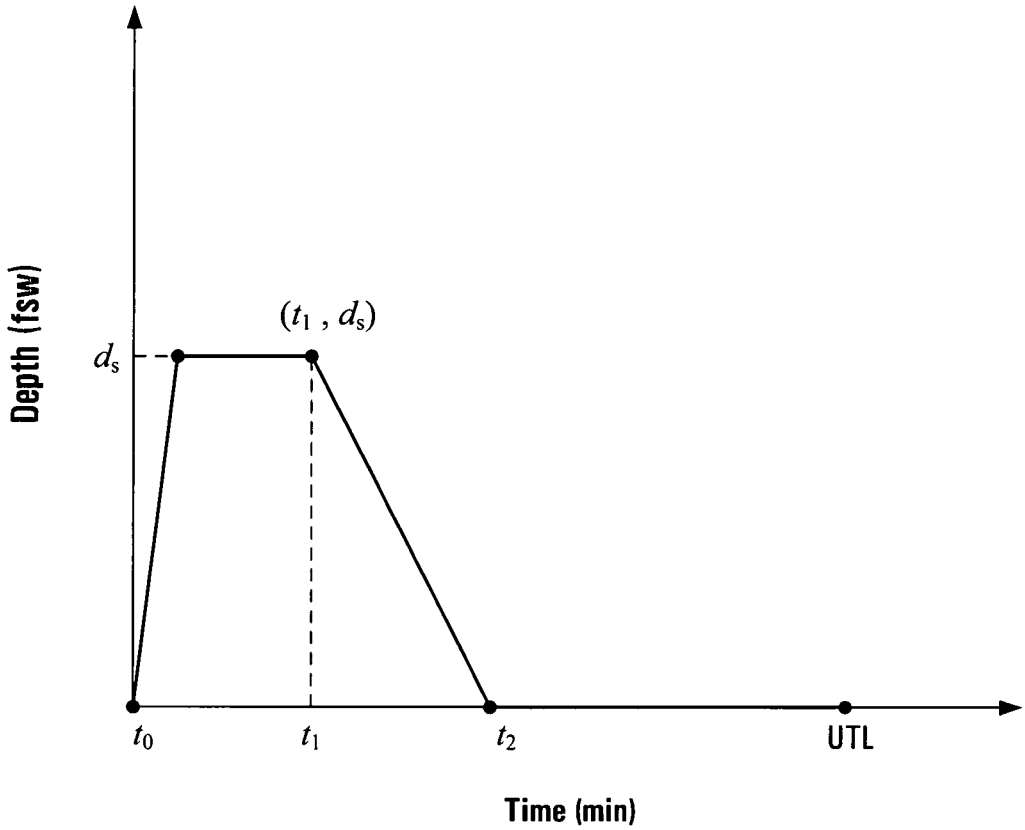
FIG. 2 is a line graph representing an exemplary dive profile.

To further illustrate, an example of a dive profile for a single saturation dive is illustrated in FIG. 2, where "fsw" means "feet sea water". In this example, it is assumed that the diver uses air as the breathing gas. As is typical, the dive profile shows dive depth as a function of time, indicated by the solid lines. The diver starts the dive at $t_0$, descending to a saturation depth $d_s$ at a constant descent rate. It is assumed that the diver stays at the saturation depth for sufficient time so that inert gas saturation has been reached at time $t_1$ at which point the diver ascends to the surface without a stop. The diver reaches the surface at time $t_2$. As can be appreciated, the portion of the dive profile after $t_1$, represented by line segments $t_1$-$t_2$-UTL, is the decompression portion.

From a given depth on the profile, the ambient hydrostatic pressure or the total ambient pressure ($P_a$) of the breathing mixture can be determined. As can be appreciated, the ambient pressure $P_a$ and the current depth d are related to each other: $P_a=P_{a,s}+d/y$, where $P_{a,s}$ is the ambient pressure at the water surface which is typically about one atm, and y is a constant representing the depth of water required for producing a unit pressure. In this example, it is assumed that y=33 fsw/atm. Another value of y, such as 33.066 fsw/atm, may be used for a different dive profile. For diving in fresh water, y may have a value of 34 ffw/atm, where "ffw" means "feet fresh water". It should be understood that the value of the current depth can be a value indicative of the corresponding ambient pressure. For a given breathing mixture, the partial pressure of the inert gas in the breathing mixture ($P_{a,n}$) at any given depth can also be calculated. For example, for normal air, $P_{a,n}\approx 0.79\ P_a$. For different breathing mixtures such as when the oxygen content is enriched or reduced or when the oxygen partial pressure is fixed, $P_{a,n}$ needs to be calculated differently as can be understood by persons skilled in the art.

As can be appreciated, an actual dive profile can be approximately represented with a dive profile consisting of linear segments, including ramp (sloped) segments and level segments, as illustrated in FIG. 2. For the ramp segments, $P_{a,n}$ changes linearly over time, while for level segments, $P_{a,n}$ is constant over time.

An instantaneous risk of DCS per unit time to the diver at any time "t" along the dive profile can be calculated using the calculated modeled gas pressures in system 10 as follows. The instantaneous risk of DCS per unit time at time "t", also referred to herein as the "decompression risk", is denoted r(t), which is sometimes referred to in the literature as the risk function. In comparison, the risk of DCS as used herein refers to the accumulated and ultimate risk of DCS to the diver after a given period of decompression, such as after a dive. The risk of DCS is related to the probability that a person will suffer DCS after the person has been exposed to the breathing mixture for the given period of time. The latter is denoted as $P_{DCS}$.

To calculate $P_{DCS}$, the pressure of the inert gas in the breathing mixture ($P_{a,n}$) is used as the pressure of the model gas in the environment, that is, the modeled environmental gas pressure ($P_e$) is set always equal to $P_{a,n}$, which varies with the current depth in a dive. The modeled gas pressures in compartments 12 and 14 ($P_{cc}$, $P_{ca}$, $P_{cb}$) are initially set equal to the initial value of $P_{a,n}$. Values of $f_c$, $f_a$, and $f_b$ may be selected in a suitable manner, such as by calibration as further illustrated below. Values of $P_{cc}$, $P_{ca}$ and $P_{cb}$ at any later time can then be calculated from the given values of $f_c$, $f_a$, $f_b$ and $P_{a,n}$, as described above.

With these initial and environmental conditions, the pressure of the model gas in each compartment 12 or 14 at any given time within a profile segment can be expressed in an analytical form dependent on the eigenvalues and eigenvectors for system 10, the parameters $f_c$, $f_a$, and $f_b$, the modeled environmental pressure ($P_e$=$P_{a,n}$), and the initial pressures of the model gas in the compartments at the beginning of the segment. The particular form of the expression can be readily derived by those skilled in the art according to known techniques. Since the linear segments in the dive profile are connected one after another and the end conditions of a preceding segment are the initial conditions of the next segment, the pressures at all connecting points (also known as nodes) in the dive profile can be sequentially determined. As can be understood, it may be necessary to calculate the pressures in all compartments 12 and 14 at each of the connecting points of the dive profile in order to determine the value of $P_{cc}$ at an arbitrary point in the dive profile. In any event, the value of $P_{cc}$ for any given time in the dive can be determined as described above.

Given the pressures, the risk of DCS can be determined as described below.

The risk function r(t) can be calculated from $P_a$, $P_{a,n}$ and $P_{cc}$. The risk function may have various suitable forms. For example, it can be expressed as, $$r(t) = \begin{cases} c\Delta P(1+\Delta P), & \text{when } \Delta P \geq 0; \\ 0, & \text{when } \Delta P < 0. \end{cases} \tag{3}$$

As the value of r(t) cannot be negative, r(t) is set to zero when ΔP is negative at any time t. In Equation (3), c is a constant having the dimension of 1/t, and $$\Delta P=(P_{cc}-P_a-P_{th})P_a^m/P_u^{m+1}. \tag{4}$$

Here m is a constant that can have any value, $P_{th}$ is a "threshold pressure", and $P_u$ is the unit pressure. As can be appreciated, ΔP is dimensionless.

The value of "m" can be determined by calibration, as will be further described below, and may have a value of −1, 0, 1, 2, or the like. Test calculation results indicate that in at least some applications it can be advantageous to set m=2, because, for example, when m=2, accurate predictions may be obtained for dive profiles where much or most of the decompression occurs underwater. The observational data used in the calibration of m was taken from the USN EDU1157 dataset, which is provided in D. J. Temple et al., "The Dive Profiles and Manifestations of Decompression Sickness Cases after Air and Nitrogen-Oxygen Dives," Bethesda, MD: US Navy, Naval Medical Research Center (NMRC), NMRC 99-02 Report, (1999), vol. 1, Section I, Part M ("Temple"), the contents of which are incorporated herein by reference. This dataset is suitable for determination of "m" because the dive profiles in the dataset include many (5 to 9) underwater plateaus over which most of the DCS risk takes place. In contrast, many other datasets include dive profiles where the DCS risk arises mainly at the water surface, and are therefore not suitable for determining a value for "m". As can be appreciated, $P_a^m$ is not sensitive to the value of "m" when $P_a$ is about one atm. Therefore, for profiles in which most (e.g., >90%) of the contribution to $P_{DCS}$ comes from surface decompression (assuming $P_a$ is about one atm at the surface), the value of "m" may have little or no significant effect on the predicted values of $P_{DCS}$.

$P_{th}$ is dependent on ambient pressures and can be expressed in the form of:

$$P_{th}=P_{a,n}[\alpha-\exp(-\beta/P_a)]-P_a, \tag{5}$$

where α and β are constants dependent on the breathing mixture. The form of Equation (5) is similar to an expression given in B. R. Weinke, *Modern Decompression Algorithms: Models, Comparison and Statistics*, available online at "www.dmscuba.com/Modern_Deco.pdf" as of Nov. 29, 2005 ("Weinke"). The values of α and β, however, may differ from the values given in Weinke, supra, and can be determined by calibration as can be understood by persons skilled in the art. The values of α and β may be calibrated by requiring Equation (5) to satisfy certain boundary conditions. The calibration can be carried out, in part, in accordance with the techniques described in B. A. Hills, *Decompression Sickness*, Wiley, (1977), vol. 1 ("Hills"), the contents of which are incorporated herein by reference. When human data are not available, the parameters may be calibrated against animal data and then scaled to humans, as can be understood by a person skilled in the art. See for example R. S. Lillo et al., "Using animal data to improve prediction of human decompression risk following air-saturation dives," *Journal of Applied Physiology*, (2002), vol. 93, pp. 216-226, the contents of which are incorporated herein by reference.

In some applications where the breathing mixture is air, the values of α=2.158 (dimensionless) and β=0.322 atm may be suitable. These values were obtained by calibration as described above. Other suitable values of α and β may also be used depending on the application.

$P_{th}$ may also be determined in another manner, as can be understood by persons skilled in the art. For instance, $P_{th}$ may simply be set to zero, or another constant value determined such as by calibration. However, a value of $P_{th}$ determined according to Equation (5) may lead to more accurate results in many situations, in comparison with a constant $P_{th}$. Further, it can be appreciated that when $P_{th}$ is calculated using Equation (5), the same risk function can be suitable for dives where the water surface is at sea level or at altitudes above sea level.

The risk function r(t) can thus be readily determined when the constant "c" is known or prescribed. An optimal value of "c" may be determined by calibration as will be described below.

It can now be appreciated that, as shown in Equation (3), the risk function r(t) only expressly includes a contribution from the central compartment 12. No contribution from peripheral compartments 14 is expressly included in the risk function.

As can be understood by persons skilled in the art, the risk function r(t) can be calculated in a different manner. For example, as can be appreciated, the pressure of a gas in a given space is a measure of an amount of the gas in that space. Thus, the pressures may be expressed or replaced using another measure of the amount of gas. For instance, another physical quantity indicative of the amount of gas accumulation, such as the concentration or the density may be used instead of the pressure. In such a case, the solutions to the rate equations of the compartmental mammillary system may have a different form and the prescribed parameters may have different values, as can be appreciated by persons skilled in the art. As can be understood, the rate equations can be readily solved on a quantity basis, as well as on a pressure basis. The functional form for calculating the risk function from other measures of an amount of the gas, such as densities or concentrations, can be readily determined by persons skilled in the art, such as by making suitable modifications to Equations (3) to (5).

Further, one or more of Equations (3) to (5) may have different forms. As can be understood by persons skilled in the art, the influence of the so-called "metabolic gases" ($H_2O$, venous $O_2$, and venous $CO_2$) which are also known as "fixed venous gases" may be used to derive an expression for calculating $\Delta P$ different from Equation (4). Such an alternate expression may stem from the use of a mechanically based criterion for bubble growth, which may be to be related to the risk of DCS. In a different embodiment, a risk function having a simpler functional form, such as $r(t)=c\Delta P$, may be used. Risk functions in the form of $r(t)=c\Delta P$ have been used in some conventional decompression models, as discussed, for example, by P. Tikuisis et al, in "Use of the maximum likelihood method in the analysis of chamber air dives", *Undersea Biomedical Research,* 1988, vol. 15, pp. 301-313 ("Tikuisis I"), the contents of which are incorporated herein by reference. Also, different values of "c" may be chosen in different applications. More than one empirical parameter may also be included in the risk function.

In another embodiment, the overall risk of DCS is calculated from gas pressures in two or more compartments and the overall risk function r(t) may be a weighted sum of two or more risk functions, i.e., $r(t)=\Sigma_i w_i r_i(t)$. Each (compartmental) risk function $r_i(t)$ represents the contribution to the overall risk of DCS from a different compartment and may have the same form as in Equation (3). The two or more compartments included in the calculation of the overall risk function may include a peripheral compartment, or two or more central compartments. The weighting functions ($w_i$) may be determined by calibration, as will be understood by persons skilled in the art. In this embodiment, the human body may be represented by several IC systems arranged in parallel, and each $r_i(t)$ may represent the risk contribution from the respective central compartment in the respective IC system.

However, calculating the decompression risk using Equations (3) to (5), with the parameters disclosed herein, can be advantageous. Equation (3) can be applicable to both low and high risk dives. As can be appreciated, Equation (3) reduces to $r(t)=c\Delta P$ for low risk dives where $\Delta P<<1$. Further, satisfactory predictions can be obtained using Equations (3) to (5) with a relatively simple model and relatively few empirically determined parameters.

Another possible alternative form of r(t) is $r(t)=\Sigma_i c_i \Delta f(P_i)$, where $c_i$ is a prescribed or empirical parameter, $P_i$ is the modeled pressure in a compartment, and $f(P_i)$ is a function of $P_i$. For example, $f(P_i)$ can be a modeled bubble volume ($V_{b,c}$) in the central compartment and $\Delta f(P_i)=(V_{b,c}-V^0_{b,c})$, where $V^0_{b,c}$ is the initial volume of bubbles in the central compartment, or a threshold bubble volume below which the bubbles are assumed to not contribute to the risk of DCS. $V_{b,c}$ may be explicitly or implicitly dependent on the Henry's law-based gas pressure in the central compartment $P_{cc}$. Therefore, $V_{b,c}$ may be measured by $P_{cc}$ and $(V_{b,c}-V^0_{bc})$ may be measured by $\Delta P$. In other words, the risk function may be a function of a modeled measure of at least one of a degree of supersaturation and an extent of bubble formation in the central compartment, Without being limited to any particular theory, it is generally accepted that decompression sickness is often accompanied by the presence of inert gas bubbles in the venous circulatory system. While these bubbles are generally not believed to cause decompression sickness, they can provide a measure of decompression stress. Decompression stress refers to physiological stress experienced by a human body that can culminate in DCS. The physiological stress stems from a state of inert gas supersaturation in the blood and tissues of the body. The presence of bubbles can be detected by ultrasonic Doppler-based and imaging techniques as described in the literature, including, for example, R. Y. Nishi et. al., in *Bennett and Elliott's Physiology and Medicine of Diving,* $5^{th}$ edition, Philadelphia, W. B. Saunders, 2003, Chapter 10.3, the contents of which are incorporated herein by reference. It has been found that Doppler bubble grades correlate positively with the risk of DCS, particularly when the grades are high. See for example, R. E. Rogers, "DSAT Dive Trials-Testing of the Recreational Dive Planner", in M. A. Lang and R. D. Vann eds., *Proceedings of Repetitive Diving Workshop*, AAUSDSP-RDW-02-92, Costa Mesa, Calif.: American Academy of Underwater Sciences, 1992, pp. 299-309, the contents of which is herein incorporated by reference. Bubble volumes in the body tissues can thus also be used as a modeled measure of the degree of decompression stress.

Both "dissolved gas phase" and "separated gas phase" forms of risk functions are in current use for conventional decompression models. The conventional risk functions are all formulated to act as measures of decompression stress. While Equations (3)-(5) ostensibly define a risk function of the dissolved gas phase type, as discussed above, they also provide a measure of risk that can be equivalent to that provided by some risk functions used in separated gas phase (or "bubble") models. As may be appreciated, the manifest equivalence of the Bubble Volume Model No. 3 (BVM(3), a 3PC model with a bubble-based risk function of the kind described above) and USN93D (a 3PC model with a dissolved gas phase-based risk function similar to the one given by Equations (3) to (5)) has been discussed, for example, in P. Tikuisis et al., *Bennett and Elliott's Physiology And Medicine of Diving,* $5^{th}$ edition, Philadelphia, W. B. Saunders, 2003, Chapter 10.1 ("Tikuisis II"), the contents of which are incorporated herein by reference. Specifically, when these two models were calibrated against the same dataset (3322 air and $N_2$—$O_2$ man-dives), their $P_{DCS}$ predictions for a set of standard profiles (the seventeen square profiles in the depth range 35-190 fsw at the respective USN no-stop time limits for air) were, for each profile, statistically indistinguishable. Conventional bubble-based models, such as the Reduced Gradient Bubble Model (RGBM), the Thermodynamic Model (TM), the Variable Permeability Model (VPM), the BVM(3), the Tissue Bubble Diffusion Model (TBDM), and the like, make use of an explicit separated gas phase type of risk function of one kind or another. Examples of models that make use of an explicit dissolved gas phase risk function of one kind or another are the Double Exponential (EE) model, the USN93D model, the Buhlmann model (ZHL),and the like. Yet another model, the Linear-Exponential (LE) model, involves both bubbles and dissolved gas in its risk function formulation. These risk function models (dissolved phase, separated phase, and mixed) are built on an independent PC gas distribution model similar to the Haldanian distribution model described previously.

As can be appreciated, the risk function, r(t), may have a form similar to the risk function used in any of the above mentioned decompression models. For example, system 10 may be used to model bubble formation in a person, such as with the assumption that bubbles only form in central compartment 12. Since the measure of bubble formation in a compartment, such as central compartment 12, will be dependent on the degree of supersaturation in that compartment, the measure can be calculated from the relevant pressures, such as $P_a$, $P_{a,n}$, and $P_{cc}$. It is not necessary, however, that r(t) be of a form explicitly dependent on one or more of $P_a$, $P_{a,n}$, and $P_{cc}$.

In any event, with a given form of r(t), the probability of DCS ($P_{DCS}$) for a given dive profile having a decompression time period which starts at time $t_s$ and ends at time $t_e$ can be calculated as:

$$P_{DCS}=1-\exp[-R(t_s-t_e)]. \tag{6}$$

Here $R(t_s-t_e)$ is the cumulative decompression risk for the period from $t_s$ to $t_e$, and $R(t_s-t_e)=\int_{t_s}^{t_e} r(t)dt$.

In Equation (6) only the risk function derived from the gas pressure in the central compartment 12 is included. In this case, it is assumed that the peripheral compartments 14 influence the risk of DCS only indirectly by acting as sources and sinks of gas for the central compartment 12. In an alternative embodiment, risk function(s) for one or more of the peripheral compartments may be taken into account. However, including more than one risk function in the model may complicate the calculation and increase the number of adjustable parameters. It has been found that one risk function as given, for example, in Equations (3-5) is sufficient for providing satisfactory predictions in many applications.

As can be understood, the risk of decompression sickness should be zero during compression (such as during the descending or the deepest portion of a dive). Therefore the integral in Equation (6) only need be carried out over the decompression portion of a dive profile, as will be further illustrated below. Since decompression risk can be significant, and is sometimes greatest at the surface, the risk integral needs to account for surface decompression accurately. It has been found that surface decompression can contribute significantly to $P_{DCS}$ because $\Delta P$ can be large at the surface. Therefore, the integral over the time period at the surface may have to be handled with care. While in theory the decompression portion of a dive can be infinite in time (i.e., $t_e=\infty$), it may not be necessary to calculate the integral beyond a finite upper time limit (UTL). Further, an approximation method of calculating an infinite integral may not be sufficiently accurate. The UTL for the integral can be determined using a suitable numerical method, as can be understood by persons skilled in the art. For instance, a bisection technique may be used. See for example, W. H. Press et al., *Numerical Recipes, the Art of Scientific Computing* (*Fortran version*), Cambridge University Press, 1989 ("Press"), pp. 246-247, the contents of which are incorporated herein by reference. An exemplary implementation of the bisection technique is described in greater detail below. For a single dive, or repetitive dives where the surface intervals are sufficiently long, the UTL can be the time at which the decompression risk first reduces to zero. However, for repetitive dives where the surface interval between two consecutive dives is short, the UTL can be the time at which the next dive starts, even though r(t) has not reduced to zero at that time.

The integral in Equation (6) with finite $t_s$ and $t_e$ may be calculated using any suitable computing technique. For example, an integral may be approximated with a suitable summation as can be understood by persons skilled in the art. When the curved lines in a dive profile are approximated with a series of straight lines (linear segments), such as illustrated in FIG. 2, the integral in Equation (6) can be conveniently reduced to one or more summations, as will be further described below. For example, for the dive profile shown in FIG. 2, $t_s=t_1$ and $t_e$=UTL, and r(t) may be calculated by adding two summations: one for the integral from $t_1$ to $t_2$ and the other for the integral from $t_2$ to UTL. The integral may be calculated according to a Gaussian Quadrature method, such as one taught in *Handbook of Mathematical Functions with Formulas, Graphs, and Mathematical Tables*, Milton Abramowitz and Irene A. Stegun, eds., 9th printing, New York, Dover, 1972 ("Abramowitz"), the contents of which are incorporated herein by reference. Tests conducted by the inventor show that 40 Gaussian points are more than sufficient in many cases. As few as 10 Gaussian points may be sufficient in some cases.

Next, an exemplary procedure for selecting the prescribed parameters $f_c$, $f_a$, and $f_b$, and c is illustrated. In this example, the parameters are selected by calibration.

The empirical data used for the calibration can include saturation data provided in W. E. Crocker et al., "Investigation into the decompression tables, progress report on the first series of human exposures," *Medical Research Council* (*U.K.*) *R.N.P.R.C. Report*, UPS 118, (1951) ("Crocker"), the contents of which are incorporated herein by reference. The observed saturation data can be represented as:

$$P_{DCS}(\text{obs})=1-\exp\{-[(d_s-14.3)/25.1]^{4.73}\}. \tag{7}$$

Equation (7) is derived by fitting a 3-parameter Weibull function to the saturation data, using the technique described in Hills, supra, and in B. A. Hills, "The Variation in Susceptibility to Decompression Sickness," *International Journal of Biometeorology,* 1968, vol. 12, pp. 343-349, the contents of which are incorporated herein by reference. The data points selected from the Weibull function are thus quasi-observed data points.

The calculated risk of DCS for each corresponding dive profile can be re-written from Equation (6) as:

$$P_{DCS}(\text{calc})=1-\exp[-\int_{t_s}^{UTL} r(t,d_s,\text{parameters})dt]. \tag{8}$$

where $d_s$ is the saturation depth in fsw and "parameters" denote a set of selected values of the parameters which can be determined by calibration, namely, c, $f_c$, $f_a$, and $f_b$.

To calculate the risk of DCS for a given observed data point, the decompression portion of the dive profile for the data point is assumed to consist of two linear segments in the form shown in FIG. 2. It is also assumed that the diver starts the ascent from the saturation depth $d_s$ at saturation at time $t_1$, ascends at a constant rate of, for example, 60 fsw/min, and reaches the water surface at time $t_2$. The risk function reduces to zero at time UTL. The integral in Equation (8) for each saturation dive profile in the dataset selected can be carried out over two linear segments, a ramping segment from $t_1$ to $t_2$ and a surface segment from $t_2$ to UTL, using a Gaussian Quadrature method.

Suitable sets of quasi-observed data points can be selected from pre-selected risk ranges to calibrate the model for use at different risk levels. For example, data points may be selected from three risk ranges, including a mild range of 0.1% to 10% (or 0.001 to 0.1), a moderate range of 0.1% to 13.5%, and a severe range of 0.1% to 67.3%. The mild range can be selected to cover the range of likely risks of DCS encountered in recreational diving, and can include 11 data points at saturation depths ($d_s$) of 20, 21, 22, 23, 24, 25, 26, 27, 28, 29, and 29.898 fsw. The moderate range can have one additional point at 31 fsw, and the point at 29.898 fsw may be replaced by a point at 30 fsw. The severe range may have 10 additional points, with the maximum saturation depth at 40 fsw. As can be appreciated, it may be advantageous to select data points that "smoothly" cover the entire range of risk.

The optimal parameter values for each range can be determined by minimizing a function "F" for the selected data points in the range, where $$F = \sum_{i=1}^{N} [w_i\{P_{DCS}(calc)_i - P_{DCS}(obs)_i\}]^2, \tag{9}$$

$$w_i = \left[\sum_{i=1}^{N} P_{DCS}(obs)_i\right] \Big/ P_{DCS}(obs)_i,$$

and N is the number of data points in the range.

As can be appreciated, this is a weighted least-squares fit and the lower risk points are given more weight (on an absolute basis) than the higher risk points. This type of weighting can overcome some problems one may encounter when fitting data over a large data range, such as when the fitting range is of two to three orders of magnitude. For example, using a constant weight may result in large percentage deviations in the lower risk range, which is the range particularly relevant to recreational diving. The use of the weight function shown in Equation (9) may have the effect of minimizing the sums of squares of the relative or percentage deviations, as opposed to minimizing the sums of squares of the absolute deviations. As may be appreciated, this form of weighting is typically used when the fitting range is large and the low points are important. In different embodiments, another form of weighting may be used.

Three exemplary sets of the prescribed parameters for air as the breathing mixture are shown in Table I. The values shown are the results of calibration carried out as described above. The indicated uncertainty ranges represent the 95% confidence intervals, assuming a normal distribution.

TABLE I

| | Exemplary Parameters | | |
|---|---|---|---|
| | Risk Level | | |
| | Mild | Moderate | Severe |
| Risk Range (%) | 0.1-10.0 | 0.1-13.5 | 0.1-67.3 |
| Saturation Depth (fsw) | 20-29.898 | 20-31 | 20-40 |
| $f_c$ (1/min) | 2.11 ± 0.04 | 2.09 ± 0.04 | 2.09 ± 0.04 |
| $f_a$ (1/min) | 0.73 ± 0.07 | 0.69 ± 0.07 | 0.68 ± 0.07 |
| $f_b$ (1/min) | 0.0100 ± 0.0006 | 0.0127 ± 0.0004 | 0.0148 ± 0.0007 |
| c (1/min) | 0.260 ± 0.015 | 0.252 ± 0.015 | 0.252 ± 0.015 |

Each of columns two to four in Table I shows the values of one set of parameters. The three sets of values were respectively obtained by calibration against observed data in three different risk regimes (obtained by using three different ranges of saturation depths, as indicated). As can be seen, for different risk levels, the parameters have slightly different values. As can be appreciated, this may be due to "lumping", as described in Jacquez, supra, at p. 143. Lumping may arise when a complex organism such as the human body is represented by a simple compartmental model with relatively few compartments.

The parameter values listed in Table I can be used for calculating risks of DCS as described herein. In some embodiments, one set of parameter values in one or another column of Table I may be used. In alternative embodiments, two or all three sets of parameter values in Table I may be used, as for example in an embodiment where the overall risk function is expressed as a weighted sum of more than one risk function. Also, a particular set can be selected in each particular calculation depending on the expected risk range (or range of expected probability of DCS) or the depth or the bottom time. As can be appreciated, the values of the parameters used in different embodiments can be varied. For example, a parameter may have a value within the corresponding uncertainty range given in Table I.

In further embodiments, another exemplary set of parameters, $f_c$=1.029, $f_a$=3.13, $f_b$=0.00936, and c=0.311 (all in unit of 1/min), may be used. This set is obtained by calibration against the risk predictions for a set of standard square profiles calculated from the USN93D model.

The use of system 10 for predicting risks of DCS is further illustrated with exemplary embodiments of the present invention described next.

Figure 3:
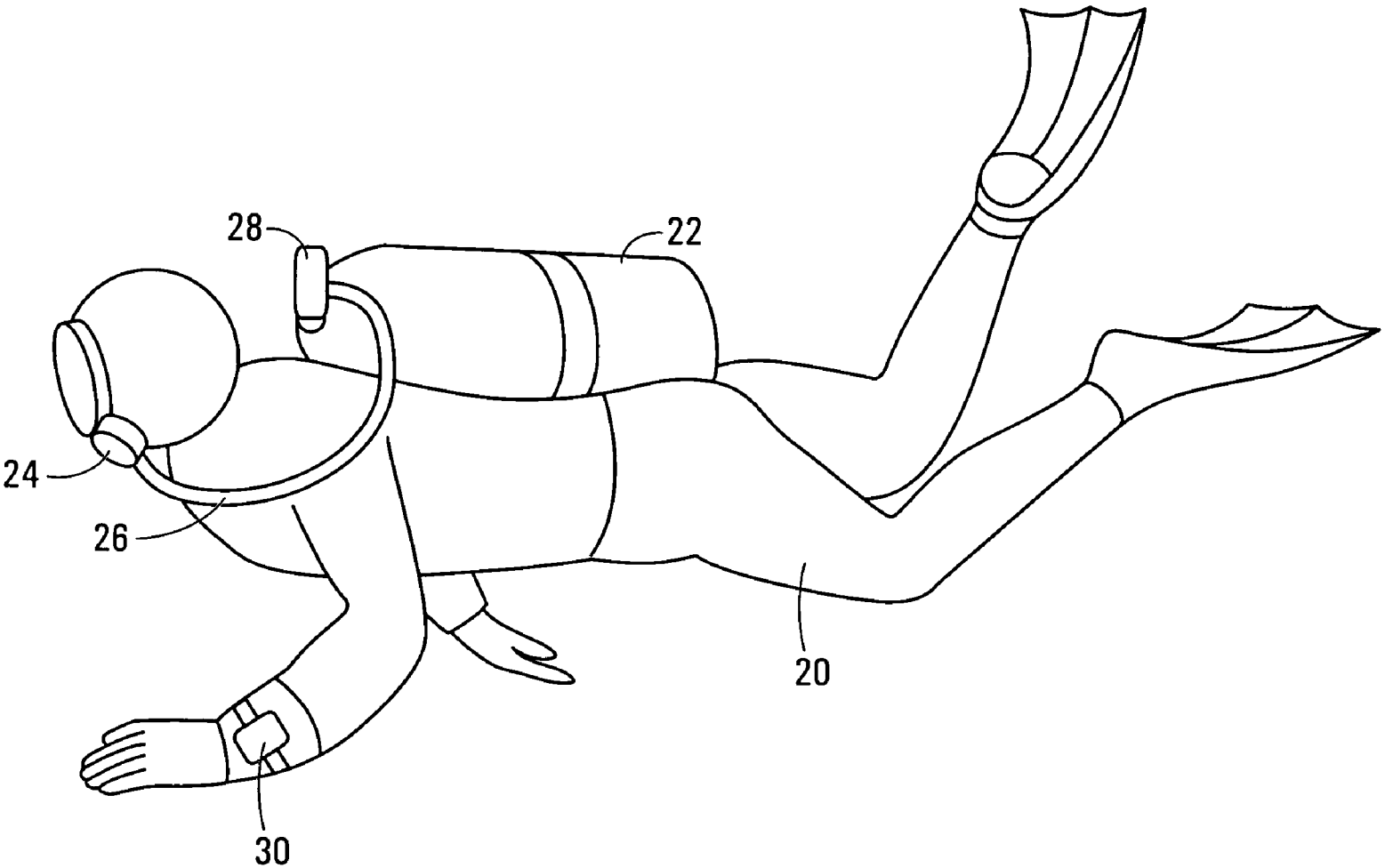
FIG. 3 is a schematic diagram of a diver carrying a dive computer.

FIG. 3 illustrates a diver 20 carrying a gas tank 22 which contains a breathing gas mixture (not shown). The mixture may be air or another suitable mixture containing oxygen and one or more inert gases such as nitrogen, helium, argon, neon, and the like. Suitable breathing mixtures include Nitrox, Trimix, Heliox, Heliair, Neox, and the like. The mixture may have enriched or reduced content of oxygen in comparison with air, or a fixed partial pressure of oxygen. Tank 22 is connected to a mouth piece 24 worn by diver 20 though hose 26 and a regulator 28. Regulator 28 may be a first-stage regulator and mouth piece 24 may include a second-stage regulator.

In use, the breathing mixture can be supplied to diver 20 through regulator 28, hose 26 and mouth piece 24 when diver 20 is underwater. Tank 22 may have separate chambers for storing different breathing mixtures. As can be understood, different breathing mixtures may be suitable at different depths underwater. Alternatively, diver 20 may carry two or more gas tanks each for a different or the same gas mixture. Further, a re-breather (not shown) may be used for re-feeding exhaled gas to diver 20 after removing $CO_2$ from the exhaled gas.

The gas flow and pressures from tank 22 to mouth piece 24 may be regulated. The gas pressure at the mouth piece 24 may be reduced, from the pressure in tank 22, to the ambient pressure by gas regulators, such as regulator 28 and a regulator at mouth piece 24. The oxygen partial pressure in tank 22 may also be regulated. For example, the oxygen partial pressure may be fixed within a constant range, e.g. about 0.7 atm. For simplicity, in the following description it is assumed that the breathing mixture in tank 22 is air with no special pressure control other than those typically employed in scuba diving. For other types of breathing mixtures and tanks, some adjustments and modification to the exemplary embodiments of the present invention described below may be necessary or possible, which can be readily appreciated, understood and implemented by persons of skill in the art in accordance with the teaching of this disclosure.

Diver 20 also carries a computing device such as a dive computer 30, exemplary of an embodiment of the present invention. As shown, dive computer 30 is attached to the diver's wrist like a wrist watch but it may be otherwise attached to diver 20 or carried by diver 20 in any suitable manner.

Figure 4A:
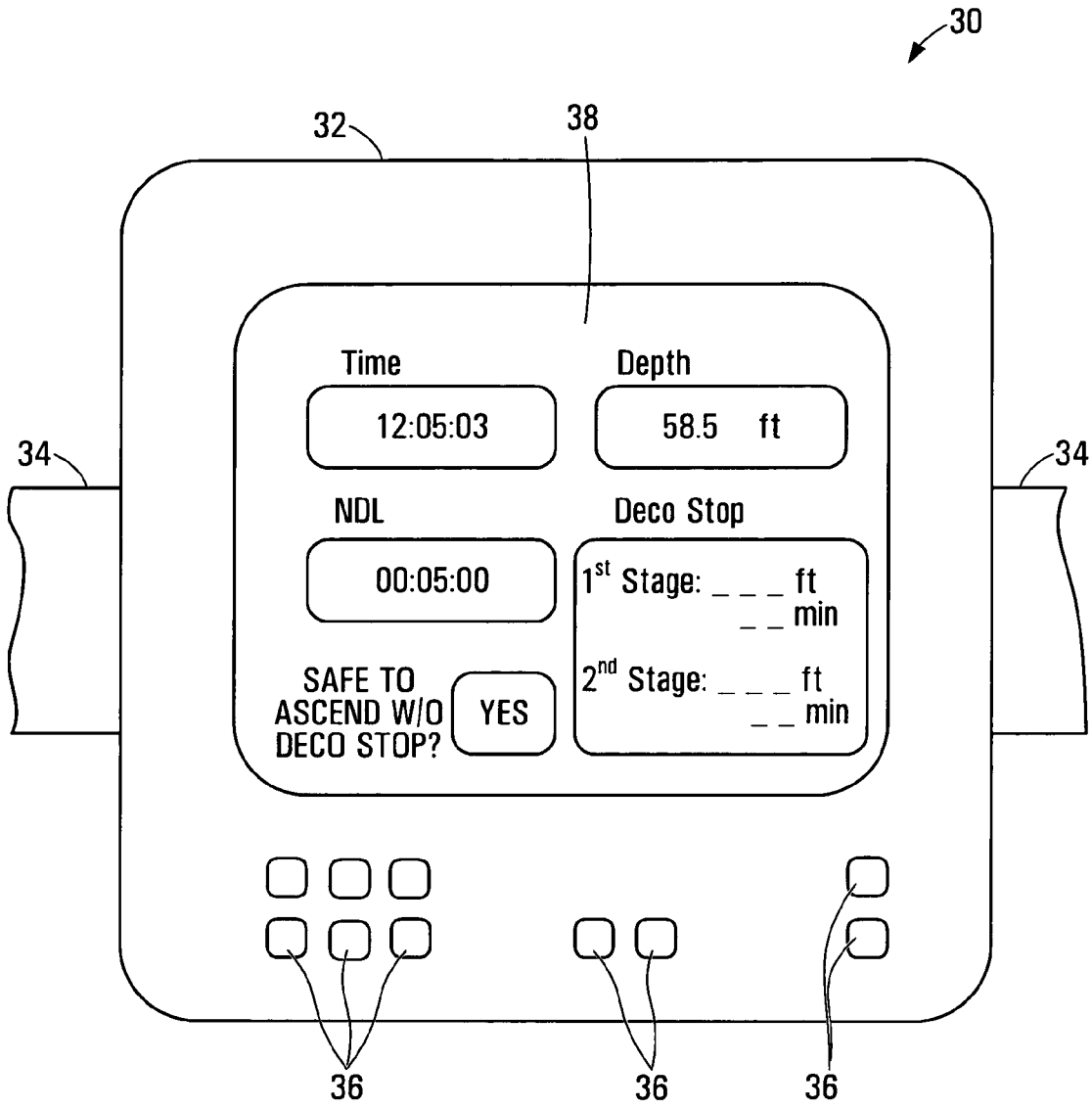
FIG. 4A is a schematic plan view of the dive computer in FIG. 3.
Figure 4B:
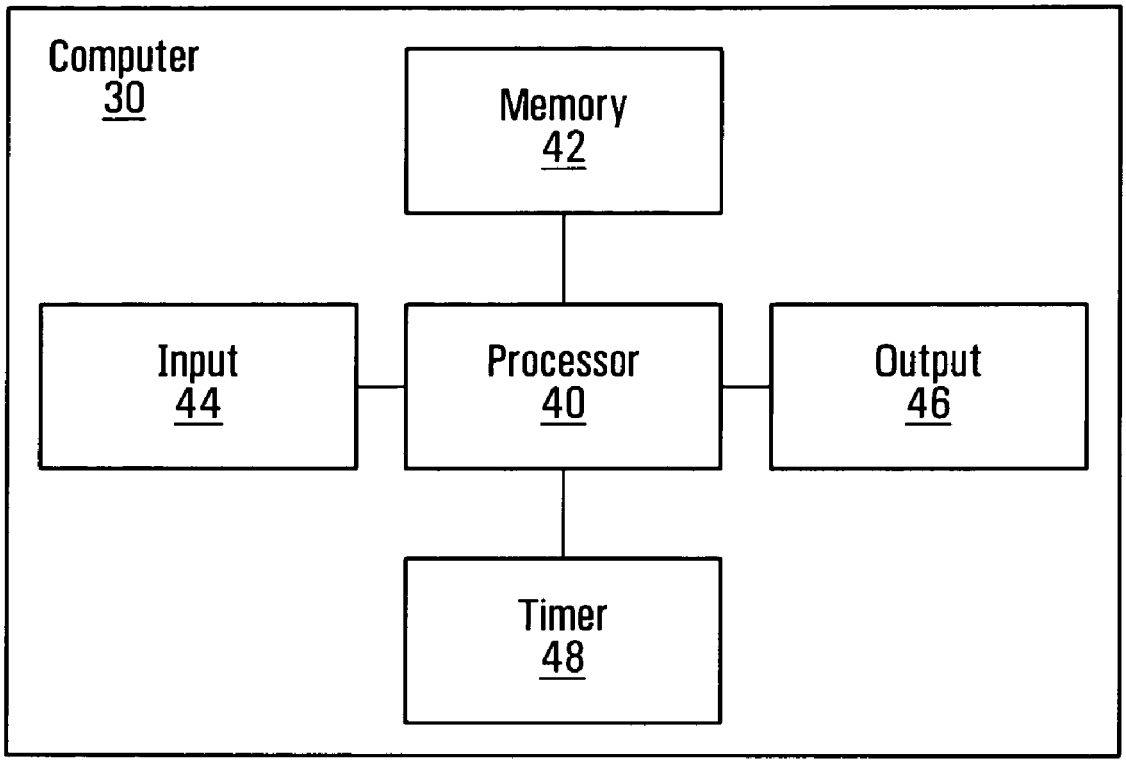
FIG. 4B is a block diagram of the dive computer in FIG. 3.

Dive computer 30 is further detailed in FIGS. 4A and 4B. As is typical, dive computer 30 has a waterproof casing 32 for housing various components therein. A strap 34 can be attached to casing 32 for carrying dive computer 30. Various operating buttons or keys 36 are provided on dive computer 30 for input and control. A visual display area 38 is also provided for displaying diving information. Display area 38 may include one or more LCD screens.

As shown, the display area 38 may display the current time, depth, and the remaining time to the No-Decompression Limit (NDL) at the current depth for the current dive. It may also indicate whether it is safe to ascend to the surface without a decompression stop, and if not, indicate the recommended decompression schedule or protocol—the recommended stop depth(s) and the stop time (duration) at each stop depth. In alternative embodiments, it may also display other information related to decompression, such as a history of previous dive profiles, safe depth-vs-time combinations for subsequent dives, the time spent so far at the current surface interval, surface interval requirements prior to ascending to high altitude or getting on an airplane, and the like. In some embodiments, information related to the gas content or pressure in tank 22 may also be displayed.

The displayed information is provided by the electronic components and circuits housed inside casing 32. As schematically shown in FIG. 4B, dive computer 30 typically includes a processor 40, memory 42, input 44 and output 46. A time piece such as a timer 48 is also provided.

Processor 40 can be any suitable processor such as microprocessor typically found in a portable computer or dive computers, as can be understood by persons skilled in the art.

Memory 42 can include one or more computer readable media. The computer readable medium can be any suitable medium, as can be understood by a person skilled in the art. Memory 42 may store computer executable instructions for operating dive computer 30 in the form of program code, as will be further described below. Memory 42 may also store data such as operational data, dive information, and output information to be displayed in display area 38.

Input 44 is to be broadly interpreted and can include user input devices, such as buttons, keys, and the like, for receiving user input such as dive information and operation commands. It can also include sensors, detectors, or transducers for detecting, for example, a signal indicative of the ambient hydrostatic pressure. Input 44 may also include a device for obtaining a signal indicative of the gas flow rate from tank 22 or gas pressure in tank 22. Such signals may be communicated to input 44 through wired or wireless communication, as can be understood by persons skilled in the art.

Similarly, output 46 is also to be broadly interpreted. Output 46 may include any devices for displaying information to diver 20. For example, output 46 may include an LCD display in display area 38. Output 46 may also include devices for communicating signals such as control signals to another device. For example, output 46 may include a device for regulating gas flow in hose 26, or for switching gas chambers/tanks at a given depth. Output 46 may include visual or audio output devices, or a combination of both.

Time piece 48 can be any suitable time keeping or tracking device, as can be understood by persons skilled in the art. Time piece 48 may generate a signal indicating the current time and may communicate the signal to processor 40.

The hardware in dive computer 30 may be manufactured and configured in any suitable manner, including that for a conventional dive computer with the exception that the risk of DCS is assessed differently in dive computer 30 as will be described below. As can be understood, the processing methods and algorithms may be implemented with either hardware, or a combination of hardware and software. The software for use in dive computer 30 may be readily developed and implemented by persons skilled in the art after reading this paper.

In some embodiments, the computer can be adapted such that the display can be temporarily disabled, such as for a day or so, to ensure that the user cannot use the computer during that period. Such a feature may be desirable in cases when the diver has missed a recommended decompression stop, as a safety measure.

Conventional components of dive computer 30 may be implemented according to or modified from the teachings of, for example, U.S. Pat. No. 4,192,001 to Villa, published 4 Mar. 1980; U.S. Pat. No. 5,570,688 to Cochran and Allen, published 5 Nov. 1996; U.S. Pat. No. 6,321,177, to Ferrero et al, published 20 Nov. 2001; patent application publication Nos. US 2003/0220762 to Furuta and Kuroda, published 27 Nov. 2003; US 2003/0056786 to Hollis, published 27 Mar. 2003; US 2005/0004711 to Hirose, published 6 Jan. 2005; and publications such as F. K. Butler and D. Southerland, "the U.S. Navy decompression computer", *Undersea Hyperb. Med.,* 2001 Fall, vol. 28, pp. 213-228; A. A. Buhlmann, *Decompression: Decompression sickness*, Berlin: Springer-Verlag, 1984; R. W. Hamilton ed., *The effectiveness of dive computers in repetitive diving*, UHMS 81 (DC) Jun. 1, 1994, Kensington, Md.: Undersea & Haperbaric Medical Society (UHMS), 1995; J. Wendling and J. Schmutz eds., *Safety limits of dive computers*, Basel, Switzerland: Basel Foundation for Hyperbaric Medicine, 1995; E. D. Thalmann, "Air Tables Revisited: Development of a Decompression Computer Algorithm," *Undersea Biomed. Res.,* 1985b, vol. 12, suppl. p. 54; M. A. Lang and R. W. Hamilton eds., *Proceedings of the American Academy of Underwater Sciences Dive Computer Workshop*, USCSG-TR-01-89, Costa Mesa, Calif.: American Academy of Underwater Sciences, 1989; P. B. Bennett and D. Elliot eds., *The Physiology and Medicine of Diving,* 5th Ed., Philadelphia: W B Saunders, 2003. The contents of each of the above documents are incorporated herein by reference.

Dive computer 30 can display information related to decompression which is derived from predicted risks of DCS for a given dive profile. As can be understood, dive computer 30 can also include features for providing information related to other types of safety concerns. For example, information related to oxygen toxicity may be provided, as can be understood by persons skilled in the art.

As can be appreciated, DCS is a probabilistic event and has a chance to occur on nearly any dive regardless of its decompression schedule, although the chance may be very small. Thus, the term "safe" is used herein in a relative sense, meaning that the risk of DCS is not higher than an acceptable or tolerable level.

Figure 5A:
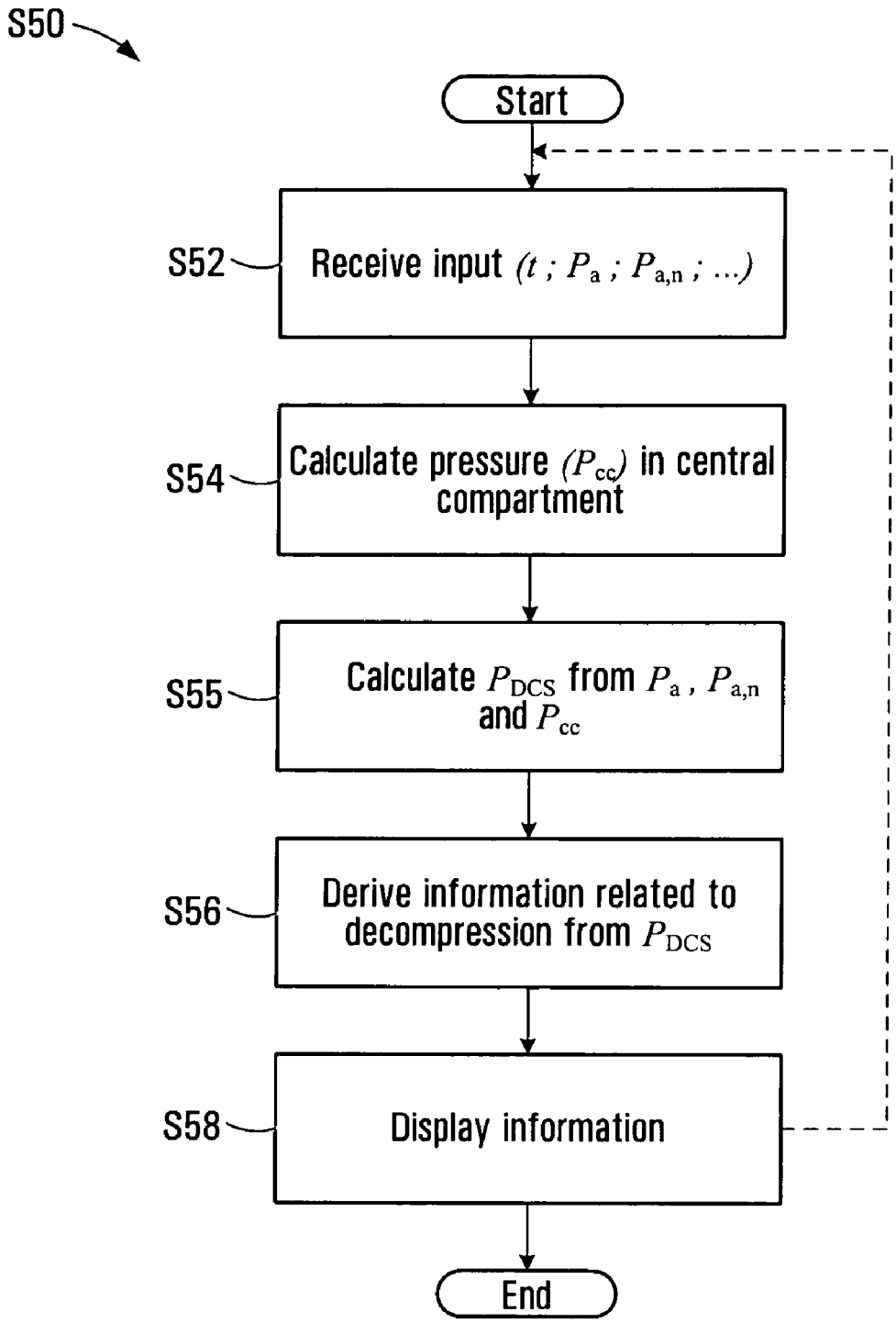
FIGS. 5A to 5E are flowcharts illustrating the operation of the dive computer in FIG. 3.

Dive computer 30 includes software that, when executed, adapts dive computer 30 to provide a mathematical model and to calculate risks of DCS using the model, according to the method S50 illustrated in FIG. 5A. The model can be based on a system such as system 10 or its variation as described above. For ease of illustration, it is assumed that the model is based on system 10.

At S52, necessary or optional time-dependent input data are obtained, which include the current time (t) and the ambient hydrostatic pressure ($P_a$) at the current dive depth. It is assumed that $P_a$ is the same or about the same as the total pressure of the breathing mixture at mouth piece 24 to which the diver is exposed. The input data may either be dynamically derived from the signals detected or received by dive computer 30, or be obtained from a dive profile stored in memory 42, such as a dive profile for the present dive. A signal indicative of the current time may be obtained from timer 48. As discussed above, a dive profile is a representation or schedule of the depth (or the ambient pressure) and the breathing mixture used as a function of time during a dive.

As mentioned earlier, a detector (not shown) may be provided in dive computer 30 for detecting the ambient hydrostatic pressure at the current depth (d). In some embodiments, the current ambient pressure may be monitored continuously at all times in a dive, or at regular intervals. As discussed before, the ambient pressure can be used to indicate the corresponding depth. In some embodiments, the current depth may be obtained from the ambient pressure and displayed to the user at desired times, such as continuously or at regular intervals.

A partial pressure of the inert gas in the breathing mixture ($P_{a,n}$) can also be obtained at S52. $P_{a,n}$ may be calculated from $P_a$, or directly measured such as with a sensor.

The values of $P_a$ and $P_{a,n}$ as functions of t can therefore be obtained.

Other data such as time-independent constants or parameters, or user options and preferences, some of which will be described below, may also be obtained before, at, or after S52, either from input 44 or memory 42.

At S54 and S55, a risk of DCS to the diver after exposure to the breathing mixture for the given dive profile is calculated using system 10, with $P_e=P_{a,n}$ and the values of c, $f_c$, $f_a$, and $f_b$ chosen so that the calculated risk is representative of the actual risk of DCS for the decompression portion of the dive. For example, the parameter values listed in Table I may be used. The parameters values used in the calculation may be stored in memory 42, or input into dive computer 30 during use, such as prior to a dive. For example, all three sets of parameter values shown in Table I may be stored in memory 42. During use, a suitable set may be selected depending on the dive profile, as can be understood by those skilled in the art. The selection can be made automatically by computer 30 or by the user. When a Gaussian Quadrature method is used, the required Gaussian points and weights may be pre-stored in memory 42.

At S54, the pressure of the model gas in central compartment 12 ($P_{cc}$) is calculated from $P_{a,n}$, as described above.

At S55, a risk of DCS to the diver after exposure to the breathing mixture for the given dive profile is calculated from $P_a$, $P_{a,n}$ and $P_{cc}$, as described above.

Since it may be necessary to calculate decompression risks over time by repeating some calculations at S52, S54 and S55, the pressure and risk values obtained at each iteration may be dynamically saved and stored in memory 42 so that when it is time to calculate a current $P_{DCS}$, the stored values can be simply retrieved without having to repeat the calculation. The software routines or programs for calculating $P_{DCS}$ can be readily developed and implemented by persons skilled in the art using suitable techniques including conventional programming techniques.

At S56, information related to decompression is derived from $P_{DCS}$ for a given dive, as will be understood by persons skilled in the art and further described below. For example, the information may include data indicative of the NDL for the current dive, or a recommended decompression schedule to be implemented on the ascent that is about to begin.

At S58, the information related to decompression is displayed in display area 38. For example, as shown in FIG. 4A, the NDL data may be displayed.

The information displayed may include data indicative of one or more of decompression risk, probability of DCS, the NDL for the current dive, a recommended decompression schedule, and the like. For example, the information may include an indication of the probability of DCS for a given dive or a warning message if that probability has exceeded a pre-set tolerance. In another example, the information may include suggested decompression stop depth and stop time (duration) when the predicted risk of DCS is too high if the diver were to ascend without a decompression stop at an assumed rate, such as about 60 fsw/min.

The information related to decompression displayed can also include other information such as the ascent rate. The actual ascent rate can be measured or calculated by computer 30, as can be appreciated. A maximum ascent rate for a safe ascent can be determined by computer 30 and displayed. When the actual ascent rate exceeds the maximum rate, computer 30 may display a visual warning message, generate an audible alarm such as one or more loud beeps, or vibrate so as to alert diver 20.

Depending on the information to be derived and displayed, dive computer 30 may include suitable hardware and software for deriving that information, as will be understood by persons skilled in the art. For example, computer executable instructions may be stored in memory 42, which when executed by processor 40 can cause processor 40 to carry out any of the calculations or processing steps described herein.

Figure 5B:
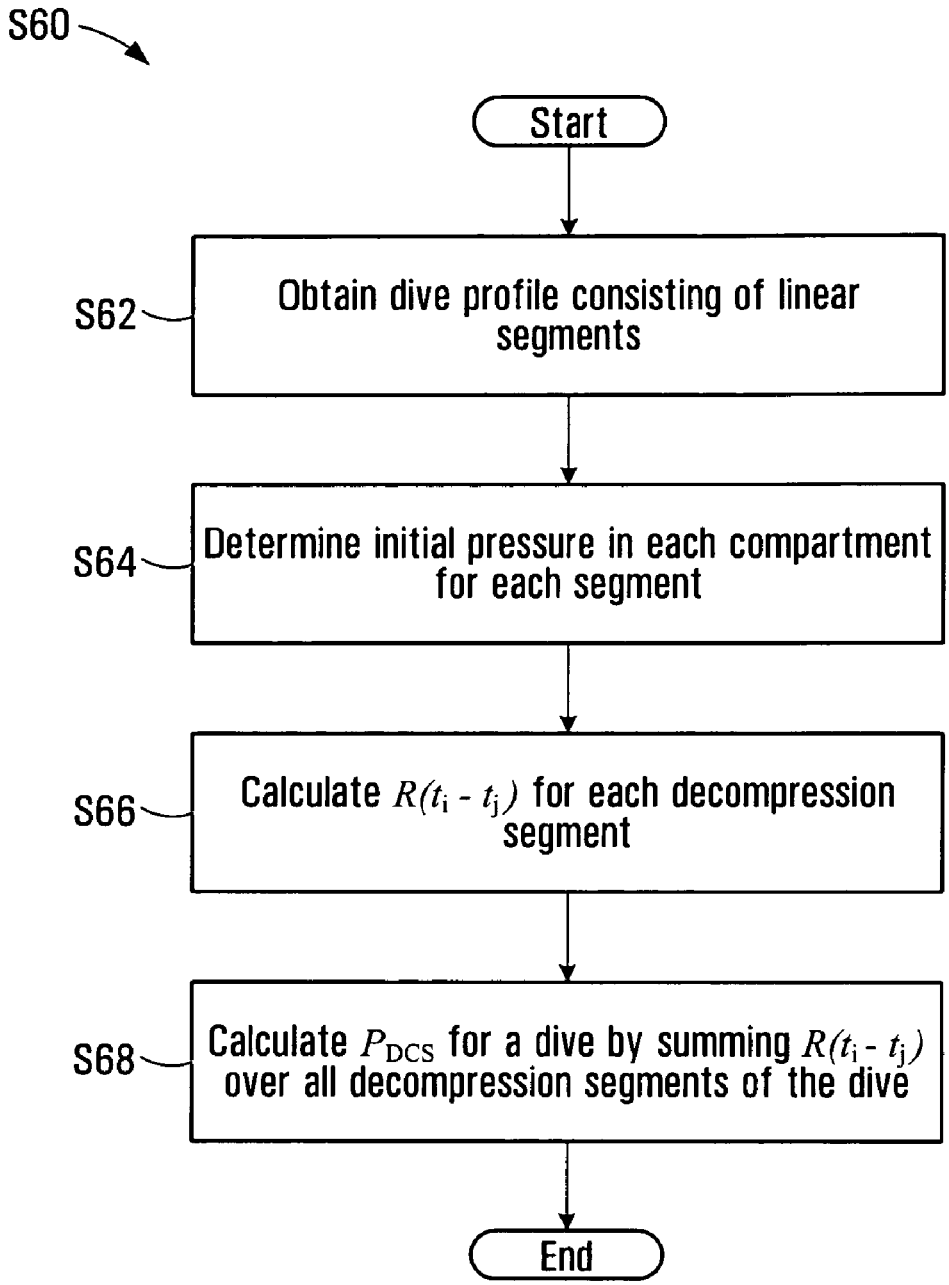
Figure 6A:
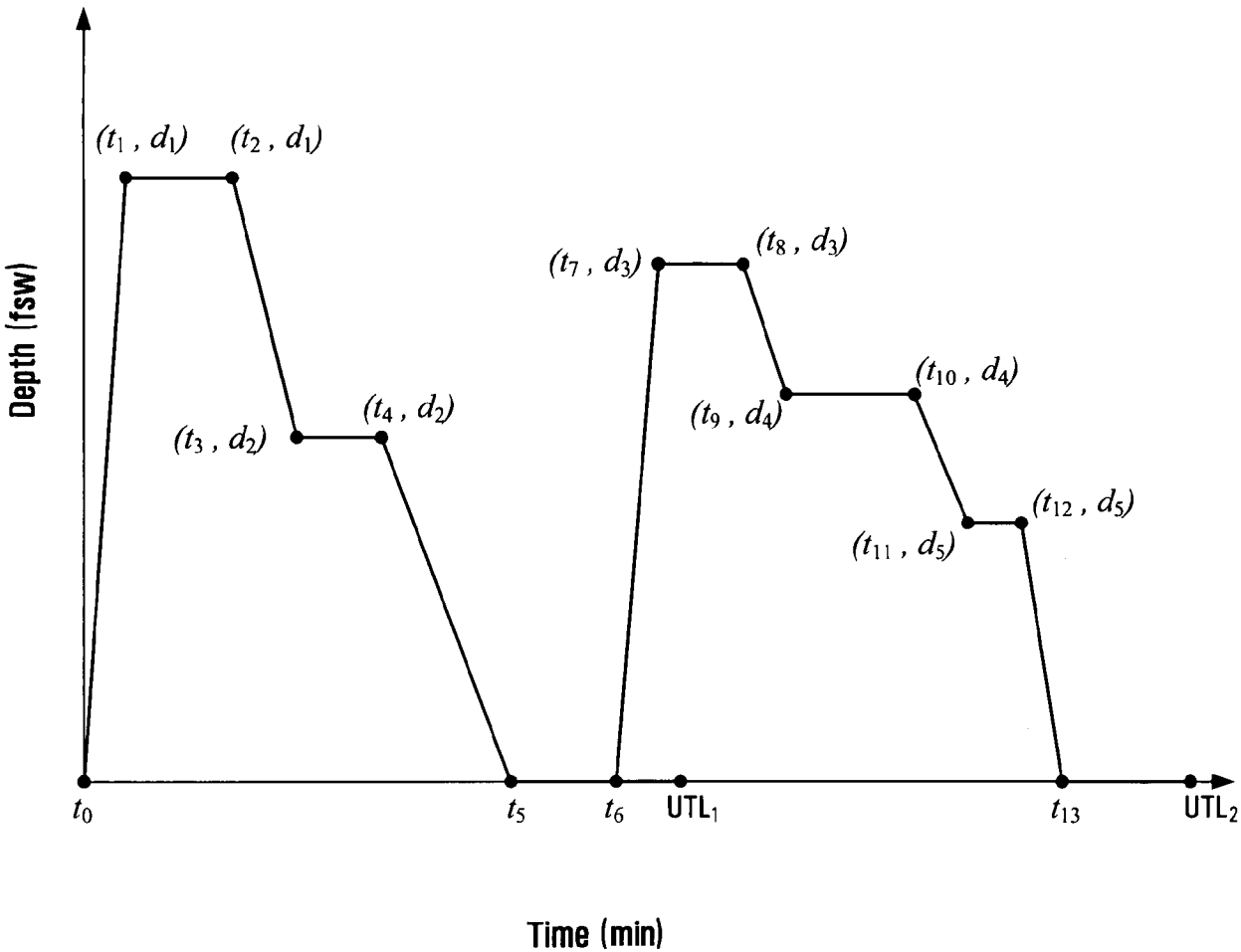
FIGS. 6A to 6B are line graphs representing exemplary dive profiles.

Dive computer 30 may calculate the risk of DCS for an actual dive profile according to the logic illustrated with the flowchart S60 shown in FIG. 5B and the exemplary dive profile shown in FIG. 6A.

At S62 of FIG. 5B, a dive profile consisting of linear segments, such as the dive profile shown in FIG. 6A, is obtained. An actual dive profile with curved segments can be approximately represented with a series of linear segments, including ramp segments in which the depth changes linearly over time and level segments in which the depth remains constant. Segments $t_0$-$t_1$, $t_2$-$t_3$, $t_4$-$t_5$, $t_6$-$t_7$, $t_8$-$t_9$, $t_{10}$-$t_{11}$, and $t_{12}$-$t_{13}$ in FIG. 6A are ramp segments, and segments $t_1$-$t_2$, $t_3$-$t_4$, $t_5$-$t_6$, $t_7$-$t_8$, $t_9$-$t_{10}$, $t_{11}$-$t_{12}$, and $t_{13}$-$UTL_2$ are level segments. The times between $t_0$-$t_2$ and $t_6$-$t_8$ are conventionally referred to as "bottom times". As can be appreciated, the segments that comprise the bottom times typically do not involve any decompression.

At S64, the gas pressure in each of compartments 12 and 14 for each connecting point of the dive profile is calculated as described above. Thus, the initial gas pressures in the compartments for each segment are determined.

At S66, the cumulative risk, $R(t_i-t_j)$, for each decompression segment, which starts at time $t_i$ and ends at time $t_j$, is determined. As mentioned before, the decompression risk only needs to be determined for the decompression portions of a dive. A decompression segment that incurs risk is one in which $P_{cc}>(P_a+P_{th})$ for at least a portion of the segment. A segment after the bottom time is usually, but not always, a decompression segment. A segment at the surface, such as segment $t_5$-$t_6$ or $t_{13}$-$UTL_2$, is typically a decompression segment.

For convenience of discussion, it is assumed below that, for the dive profile shown in FIG. 6A, segments $t_2$-$t_3$, $t_3$-$t_4$, $t_4$-$t_5$, and $t_5$-$t_6$ are the only decompression segments for the first dive and segments $t_8$-$t_9$, $t_9$-$t_{10}$, $t_{10}$-$t_{11}$, $t_{11}$-$t_{12}$, $t_{12}$-$t_{13}$, and $t_{13}$-$UTL_2$ are the only decompression segments for the second dive. Thus, cumulative risks for these decompression segments need to be determined.

At S68, the total cumulative risk R of a dive is determined as a sum of the cumulative risks for all the decompression segments in the dive. That is, $$R = \sum_{i,j} R(t_i - t_j). \tag{10}$$

For instance, for the first dive in the dive profile of FIG. 6A, the total cumulative decompression risk is: $R_1=R(t_2-t_3)+R(t_3-t_4)+R(t_4-t_5)+R(t_5-t_6)$. It is assumed that the UTL for the first dive ($UTL_1$) is larger than $t_6$ (as shown) so that the last decompression segment for the first dive ends at time $t_6$. Thus, from Equation (6), for the first dive, $P_{DCS,1}=1-\exp(-R_1)$; for the second dive, the total cumulative decompression risk is: $R_2=R(t_8-t_9)+R(t_9-t_{10})+R(t_{10}-t_{11})+R(t_{11}-t_{12})+R(t_{12}-t_{13})+R(t_{13}-UTL_2)$, and $P_{DCS,2}=1-\exp(-R_2)$.

As can be appreciated, for the dive profile shown in FIG. 6A, $P_{DCS,1}$ (with $UTL_1$ replacing $t_6$ in the above expression for $R_1$) is the predicted risk of DCS if the diver carries out only the first dive. The overall risk of DCS after the second dive is: $P_{DCS,2}$. It can also be understood that $P_{DCS,2}$ not only depends on the dive profile for the second dive but also depends on the saturation state of the diver after the first dive. For example, if at $t_6$ there still is some excess (inert) gas in the model compartments, $P_{DCS,2}$ may be higher than it would be if there were no excess inert gas at time $t_6$.

As can be understood, the risk of DCS as calculated above can be utilized to provide various information useful for diver 20 to be displayed on dive computer 30. For example, the no-stop bottom time limit, or NDL, or the recommended decompression protocol/schedule may be derived for a particular dive profile. Exemplary procedures for deriving such information are illustrated using the dive profile shown in FIG. 6B as an example and the flowcharts shown in FIGS. 5C to 5E.

Figure 5C:
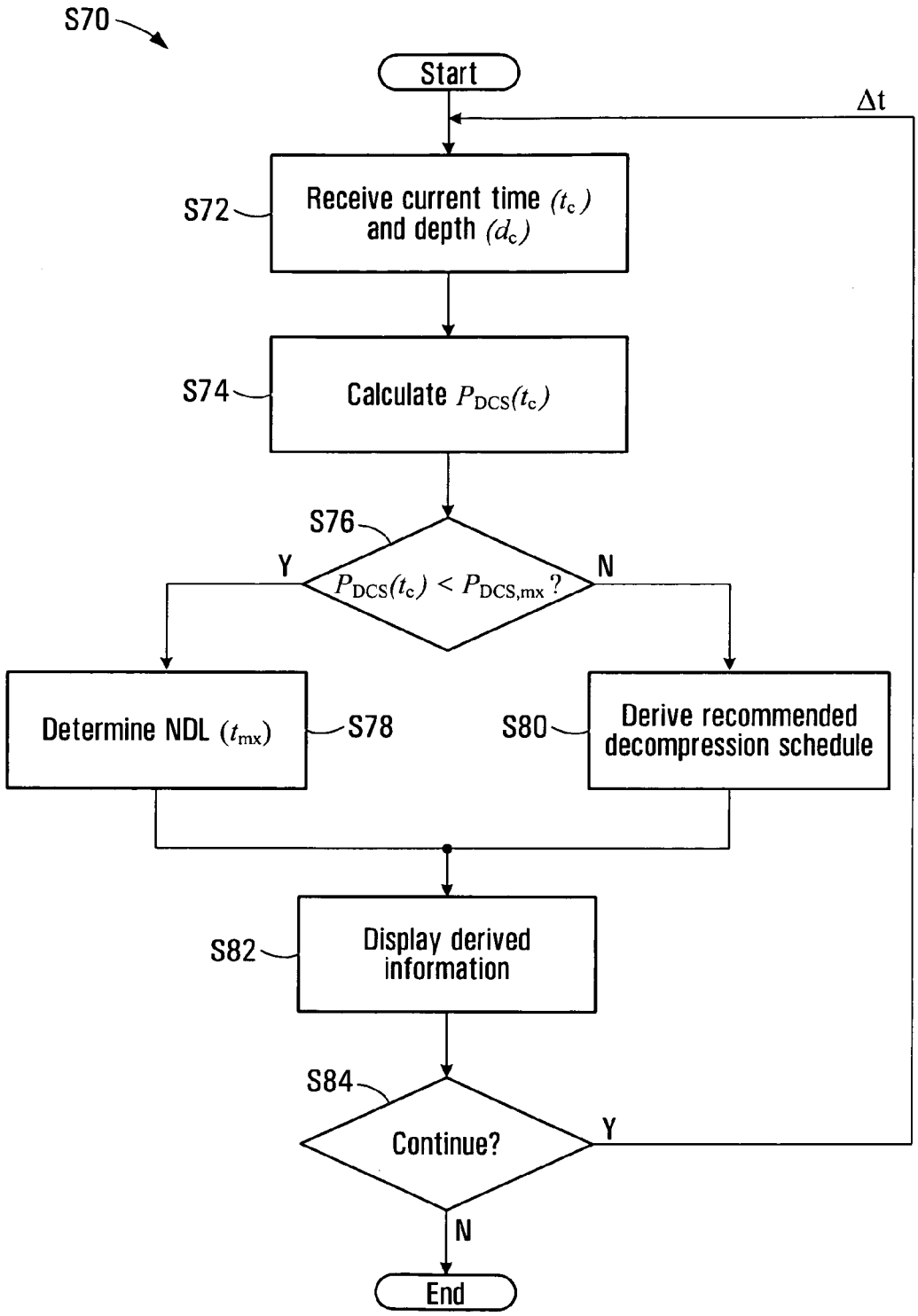

In flowchart S70 of FIG. 5C, a current time $t_c$ is obtained at S72. It is also assumed that a maximum tolerable probability, $P_{DCS,mx}$, and a constant rate of ascent have both been pre-selected. The values of $P_{DCS,mx}$ and the rate of ascent can either be pre-stored in dive computer 30 or selected by a user, such as through input buttons 36, at the time of use. For example, a typical rate of ascent, such as 60 ft/min, may be used. The value of $P_{DCS,mx}$ may be selected from a prescribed range by a user according to the user's preferences. In some applications, $P_{DCS,mx}$ may be set to 0.01.

Figure 6B:
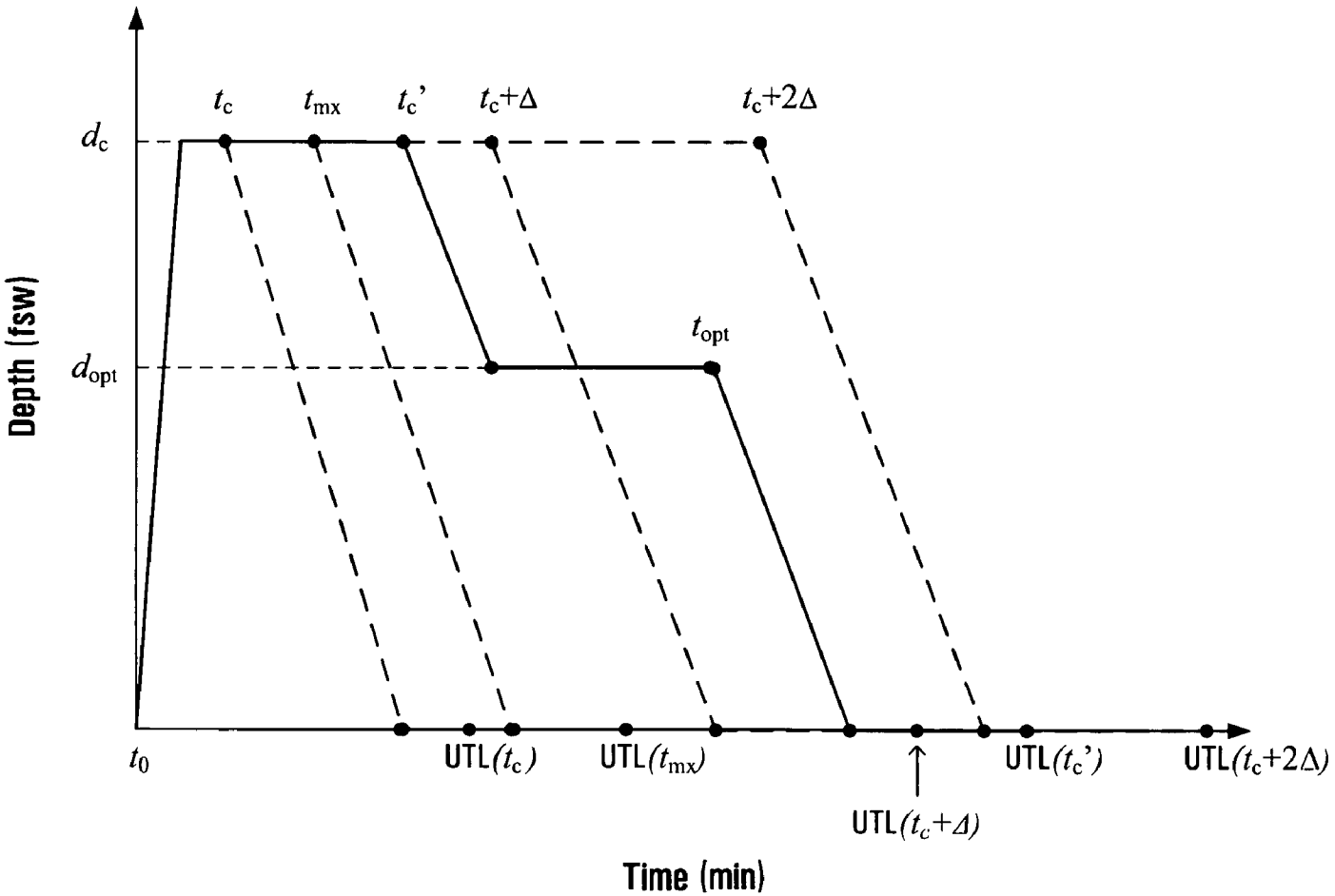

In the profiles shown in FIG. 6B, the solid line represents the actual dive profile, and the dashed lines represent "virtual" dive profiles. In all virtual dive profiles, the rate of ascent is of the pre-selected value and there is no decompression stop. In the following description, $P_{DCS}(t)$ denotes the calculated probability of DCS for the (virtual) dive profile that has a starting point of ascent to the surface at time "t". Similarly, UTL(t) denotes the UTL for the dive profile that has a starting point of ascent at time "t".

At S74, $P_{DCS}(t_c)$ is determined, where $t_c$ denotes the current time, for the virtual dive profile consisting of the segments from $t_c$ to $UTL(t_c)$.

The calculated $P_{DCS}(t_c)$ is compared with $P_{DCS,mx}$, at S76. If $P_{DCS}(t_c)$ is less than $P_{DCS,mx}$, the diver can stay at the current depth for more time without having to do a decompression stop, and the NDL is derived at S78. Otherwise, the diver cannot ascend directly to surface without a decompression stop, and a recommended decompression protocol/schedule is derived at S80. The derivation of the NDL and the recommended decompression schedule will be described further below.

The information derived is then displayed at S82.

The above process may be repeated or terminated, as determined at S84. For example, the process can run repeatedly as long as the diver is still underwater, or until a user enters a termination command. The process may be repeated at fixed intervals or as soon as a previous iteration has been completed.

To find the NDL, one can find the time $t_{mx}$ at which ascending directly to the surface at the pre-selected rate would result in a risk sufficiently close to $P_{DCS,mx}$. The value of $t_{mx}$ can be determined by an iterative numerical technique known as "bisection", as described below.

The bisection technique may be advantageously used here for quickly, accurately, and unfailingly finding the value of $t_{mx}$. This technique can be readily implemented by a person skilled in the art and has been discussed in, e.g., Press, supra.

Figure 5D:
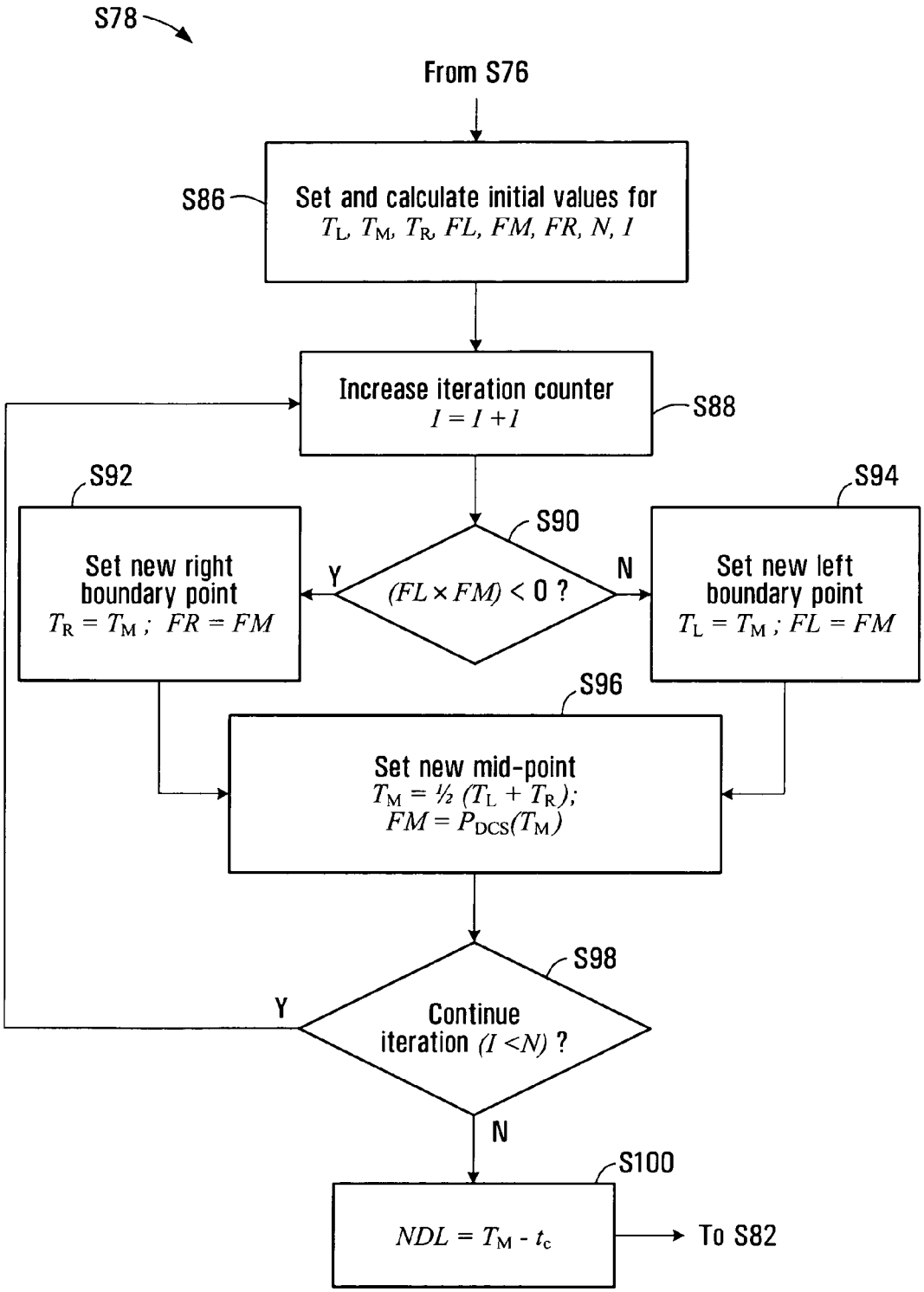

An exemplary use of bisection for finding $t_{mx}$ or the NDL (S78) is illustrated in FIG. 5D. It is assumed that an initial large time increment $\Delta$ and a small time increment $\delta$ have been pre-selected. $\Delta$ is selected to be sufficiently large so that $t_c+2\Delta$ will be greater than $t_{mx}$ with very high likelihood, which may also be verified by calculation. The value of $\Delta$ may be selected using the formula $\Delta=10^6/d_c^2$, where $d_c$ is the current plateau depth in units of feet and $\Delta$ is in units of minutes. $\delta$ can be a small time increment such as 0.0001 unit time.

At S86, the initial values are set respectively as follows.

Three initial test points (times) are set as $T_L=t_c$, $T_M=t_c+\Delta$ and $T_R=t_c+2\Delta$. Since $t_c$ is smaller than $t_{mx}$ (as verified at S76), it can be determined that $t_c<t_{mx}<t_c+2\Delta$, as shown in FIG. 6B. Thus, it can be appreciated that the points $T_L$ and $T_R$ are respectively left and right boundary points for $t_{mx}$. The probabilities of DCS for each test point are calculated and denoted as $FL=P_{DCS}(T_L)$, $FM=P_{DCS}(T_M)$, and $FR=P_{DCS}(T_R)$, respectively.

The number ("N") of iterations (or bisections) is calculated as: $N=\log_2(2\Delta/\delta)$, which will provide a final error in NDL that is no greater than $\delta$.

An iteration counter "I" is initialized to zero.

During each iteration, the counter will be increased by one, at S88.

At S90, the product of FL and FM, FL×FM, is calculated and its value compared with zero. If the value of FL×FM is less than zero, FL and FM have opposite signs and it can be expected that the true $t_{mx}$ is somewhere between the left boundary $T_L$ and the mid-point $T_M$. Thus, the right boundary $T_R$ is reset (moved) to the current mid-point $T_M$, and consequently, FR is reset to equal to the current FM, at S92. Otherwise, the true $t_{mx}$ point is somewhere from the mid-point $T_M$ to the right boundary $T_R$. In this case, the left boundary $T_L$ is reset (moved) to the current mid-point $T_M$, and consequently FL is reset to equal to FM, at S94.

At S96, the mid-point $T_M$ is recalculated as the middle point of the new boundaries, $T_M=\frac{1}{2}(T_L+T_R)$. Consequently, FM is updated as $FM=P_{DCS}(T_M)$.

At S98, the values of "I" and "N" are compared to determine if the previously determined number of iterations has been reached. If I<N, the iteration continues by returning to S88. Otherwise, the current $T_M$ is considered sufficiently close to the true $t_{mx}$, and the NDL is calculated as $NDL=T_M-t_c$, at S100.

The method described above is called a "bisection" method because the distance between the boundary points (such as $T_L$ and $T_R$ in the above example) that bound $t_{mx}$ is reduced by a factor of two with each iteration. As can be appreciated, after N iterations, $T_L - T_R \leqq \delta$ and the true $t_{mx}$ is somewhere from $T_L$ to $T_R$. Thus, the error in the calculated NDL would be less than δ. The value of δ may be selected depending on the application. For $\delta = 10^{-4}$ unit time, the value of N is between 15 to 30 for some dive profiles.

The above logic can be readily implemented using computer software and can be performed quickly. The above logic can also be varied as can be readily understood by persons skilled in the art.

As can be understood, in alternative embodiments, the absolute value of $t_{mx}$, instead of $t_{mx} - t_c$, may be taken as the NDL and is displayed.

As mentioned, the process of S70 may be repeated as long as the diver is still underwater or has not terminated the process. However, as can be appreciated, the value of $t_{mx}$ only needs to be determined once for a given level segment. In the subsequent iterations, instead of comparing values of $P_{DCS}$, the current time $t_c$ may be compared directly with the previously determined value of $t_{mx}$ at S76, as long as the diving depth has not significantly changed. If the new current time $t_c$ is still smaller than $t_{mx}$, the updated NDL simply equals the difference between the two times. On the other hand, if the new current time, such as $t_c'$ shown in FIG. 6B, is larger than $t_{mx}$, a recommended decompression schedule may be determined as discussed next.

Figure 5E:
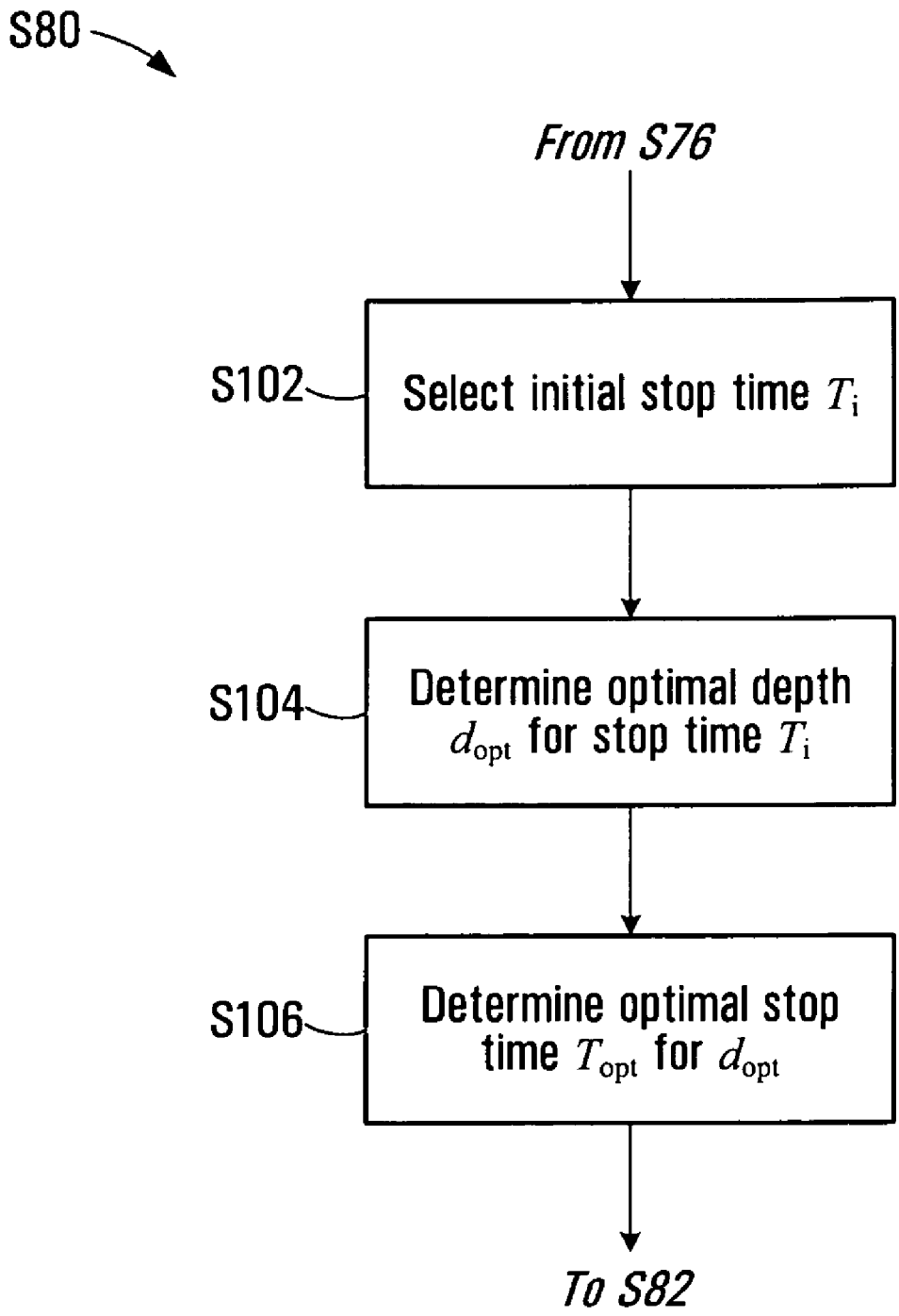

An exemplary process S80 for determining the recommended decompression schedule is illustrated in FIG. 5E. It is assumed that the current depth is $d_c$ and the diver will start the ascent at time $t_c'$, as shown in FIG. 6B.

At S102, an arbitrary initial stop time or duration $T_i$ is selected. $T_i$ can vary within a suitable range, such as from 5 to 100 minutes for some dive profiles. Test results have shown that the choice of $T_i$ has only a small, sometimes negligible, effect on the final results. Further, even if the choice of $T_i$ is not optimal, the determined decompression schedule is still safe, as will become clear and can be understood by persons skilled in the art. For some applications, 10 minutes may be a suitable value for $T_i$. In some applications, $T_i$ may have a value from 5 to 30 minutes.

At S104, the optimal depth for initial stop time $T_i$ is determined, such as described below.

For example, a number of test depths may be selected. The test depths may be selected in any suitable manner. The test depths may be pre-selected. For instance, the test depths may include depths of fixed interval, such as 5, 10, 15, 20, 25, 30 fsw, and so on. The number of test depths may vary. Alternatively, the test depths may be selected based on the current dive profile. In such a case, the test depth may be dependent on the current depth $d_c$, as can be understood by persons skilled in the art. As can be appreciated, the interval between adjacent test depths does not need to be very small. An interval of about 5 feet may be suitable in some applications.

For each test depth and the fixed stop time $T_i$, a test dive profile can be constructed. For each test dive profile, the value of $P_{DCS}$ is calculated. For the selected stop time $T_i$, the test depth that results in the minimum $P_{DCS}$ is selected as the optimal depth "$d_{opt}$". A minimum in $P_{DCS}$ with respect to stop depth (for a given stop time) can always be found. An optimal depth may be found as long as the test depths cover a sufficiently wide range. In some applications, a range of 5 to 30 feet may be sufficient.

As can be appreciated, for practical purposes, the selected optimal depth does not need to be very accurate in comparison with the true optimal depth, such as to be accurate within a foot. Thus, for example, the calculated optimal depth may be rounded to the nearest 5-foot increment.

The optimal depth may also be determined in different manners, as will be understood by persons skilled in the art.

At S106, the optimal stop time ($T_{opt}$) is determined for the optimal depth $d_{opt}$.

A bisection technique, similar to that described above, can be used to determine $T_{opt}$. Briefly, different virtual dive profiles, all with a stop at depth $d_{opt}$, can be constructed by varying the stop time iteratively in the virtual dive profile, until finding a dive profile with a stop time $T_{opt}$ for which, $|P_{DCS}(T_{opt}) - P_{DCS,mx}| < \delta$. Here, each of $P_{DCS,mx}$ and δ may have a different value than that used at S76 and S86 respectively. $P_{DCS,mx}$ may be pre-selected or entered by the diver during use. The stop time $T_{opt}$ is then selected as the optimal stop time or duration.

The values of $T_{opt}$ and $d_{opt}$ can then be displayed (at S82).

The above procedures can be modified to include multiple stops, as can be understood by persons skilled in the art. For example, for a deep bounce dive, the diver may first stop at a deep depth, such as at about ⅓rd of the maximum depth, for one minute, and then follow an optimized decompression schedule determined as described above.

As can be understood, the methods for determining the risks of DCS or $P_{DCS}$ described above may also be carried out without using dive computer 30. Other types of computing devices may be used. For example, a conventional desk top computer or laptop computer may be used, in combination with software for carrying out one or more of the methods described herein. A user may, for instance, use such a computing device to plan a dive or to design dive profiles that constrain risks to acceptable levels for various purposes. The methods may also be used for analyzing dive data and other purposes.

Exemplary embodiments of the present invention also include a device or a tool for obtaining information derived from a risk of DCS for a given exposure where the risk of DCS is determined using any embodiment of the present invention. For example, the device may include an input component for receiving data indicative of the exposure. The device may also include a storage storing risk data where the risk data contain risks of DCS associated with various exposure profiles such as dive profiles and determined as described above, and the risk data can be respectively retrieved based on exposure data input. In a further example, an embodiment of the present invention may include a dive tool, such as a dive wheel or a set of dive tables, where the dive tool is constructed based on risks of DCS determined according to the exemplary methods described above. In a more specific embodiment, the dive tool may include a set of one or more tables representing dive profiles, where the dive profiles are constructed based on the requirement that each dive profile has a risk of DCS at a prescribed level when the risk of DCS for the dive profile is assessed according to a method for predicting risks of DCS described herein. The tables may alternatively contain data necessary to construct such dive profiles. For instance, the table(s) may have the form(s) of conventional dive tables, such as those currently used in scuba diving certification programs. Known diving certification programs include those provided by the National Association of Underwater Instructors (NAUI Worldwide)™ and the Professional Association of Diving Instructors (PADI)™, as well as Diving Science and Technology (DSAT)™ which is a corporate affiliate of PADI. Dive tables may be constructed for users of such programs, from which a user may determine acceptably safe dive profiles, or information for constructing such a dive profile. The latter information may include data indicating safety stops, ascent rates, surface intervals, decompression procedures, or any combination thereof. The acceptably safe dive profile may have a risk of DCS, when determined as described herein, at a prescribed level. These tables may be included in instructional materials such as books, manuals, electronic storage media, and the like. The tables may also be presented in a wheel form or in a computer accessible database. In one specific embodiment, the tables may be presented on a sheet made from a plastic material, or another suitable water-resistant material, such that the sheet is usable under water. In another specific embodiment, the dive tool is a recreational dive planner in the form of a wheel, a card, or a sheet. These wheels and sheets can be readily made by persons skilled in the art. For example, the planner can be of a form similar to a conventional recreational dive planner, such as those provided by PADI. The manufacturing processes for producing conventional recreational dive planners, except the procedure for determining the actual data to be presented, may be readily adopted for producing recreational dive planners according to embodiments of the present invention, as can be understood by persons skilled in the art. In some situations, a user performing dives under the guidance of the dive tables of such dive tools would behave differently as compared to diving under the guidance of conventional dive tables at the same risk tolerance level, as will become more apparent below.

Test results show that the calculation procedures described above can produce accurate results quickly with a commercially available personal computer that has a moderate computing speed. The NDL and optimal decompression stop data can be computed or updated quickly, such as within 10 ms.

On the one hand, according to calculation results based on the 3CM system described above, stops (deep, intermediate or shallow) and slow ascent rates are much more effective in reducing risks of DCS for certain dive profiles than predicted by some conventional PC-based decompression models. Predicted risks of DCS for many recreational dive profiles based on the exemplary 3CM model are less than those calculated from conventional decompression models, as will be further illustrated below. Thus, by using dive computers based on conventional decompression models, a recreational diver may have to surface before it is really necessary, or take longer stops than are necessary. Therefore, an advantage of using dive computer 30 or another embodiment of the present invention is that recreational divers may enjoy more dive time without being exposed to unduly high risks of DCS for certain types of dives.

On the other hand, calculations also indicate that for certain types of recreational dives, the calculated risks of DCS based on the 3CM model are greater than those calculated using any of the PC-based models tested. These types of dives can be (a) single square dives with bottom times exceeding the NDL limits; (b) dives at high altitudes; (c) reverse dives without a sufficiently long surface interval between the dives; and (d) bounce dives at moderate depths (e.g. about 150 fsw) and using hypoxic nitrox (e.g. 90% $N_2$). Thus, the 3CM model may be advantageously used for diving more safely in certain types of dives.

As can be understood by persons skilled in the art, the mean residence time of the model gas in the central compartment of a given compartmental mammillary model at given conditions and its relative dispersion (RD) may be determined, from the q-based equations such as Equations (2B). Information related to decompression may also be derived from these values. Mean residence times and RDs for system 10' have been obtained, which are listed in Table II. The calculation was carried out by solving the q-based rate Equations (2B) analytically, subject to the condition that a single nitrogen molecule is initially present in the central compartment 12', the peripheral compartments 14' are initially unoccupied, and no further nitrogen gas is added to the compartments (i.e., $i(t)=0$ for $t>0$). The calculated values of the mean residence time are consistent with the whole-body nitrogen half-saturation times of approximately 1-4 hours reported by Hills, supra, at page 186. The calculated values of the relative dispersion are also well within the expected range which, as can be appreciated by persons skilled in the art, is from 1 to 2. These results appear to be consistent with physiologically-based expectations, indicating that the 3CM model can relatively accurately represent the human body's response to decompression stress when considered from a physiological perspective. In comparison, calculated results based on some PC models have been found to be inconsistent with empirical inert gas exchange studies in mammals, as described, for example, by J. A. Novotny et al, *Journal of Applied Physiology,* 1990, vol. 68, p. 876.

TABLE II

MEAN RESIDENCE TIME AND RELATIVE DISPERSION

| | Risk Level | | |
|---|---|---|---|
| | Mild | Moderate | Severe |
| Mean Residence Time (min) | 101 | 81 | 69.4 |
| Relative Dispersion | 1.71 | 1.70 | 1.70 |

Risks of DCS for various dive profiles have been calculated according to the methods described above using the parameters listed in Table I. The calculated results were compared with actual dive data taken from various published diving databases. The calculated results are consistent with the observed dive data over a wide range of dive profiles. Several examples of this consistency are given below.

The calculated results for certain recreational dive profiles were also compared with predictions based on PC decompression models including 2- or 3-parallel-compartment models (2PC/3PC), a Linear-Exponential model (LE), and an Double-Exponential model (EE). The 3CM model exhibited a much higher level of consistency with the empirical data than did the tested PC-based conventional models.

For some dive profiles, such as single square dive profiles in the depth range of 35-190 fsw, at the respective USN NDL limits, the 3CM model provides predictions similar to those provided by a number of conventional decompression models, such as the RGBM model described in Weinke, supra; the LE1 model described in E. D. Thalmann et al., "Improved probabilistic decompression model risk predictions using linear-exponential kinetics", *Undersea Hyperbaric Medicine,* 1997, vol. 24, pp. 255-274, ("Thalmann"), the contents of which are incorporated herein by reference; and the BVM(3) and USN93D models described in Tikuisis II, supra, at p. 449.

However, for some other dive profiles, the 3CM model predictions differ significantly from those based on the conventional models. In at least some of these cases, it appears that the 3CM predictions are more consistent with the empirical data and studies. For example, calculations show that the statistical difference between prediction and data is significantly smaller and the consistency of predictions is significantly higher in the case of a 3CM as compared to some conventional decompression models. In a comparison of predicted risks of DCS for low risk dives, the probability of consistency with a "perfect model" was found to be about 0.999 for the 3CM model, and below 0.56 for other conventional models tested. The concept and use of the "perfect"

model is described in P. K. Weathersby, L. D. Homer, and E. T. Flynn, "On the likelihood of decompression sickness", *Journal of Applied Physiology,* 1984, vol. 57 pp. 815-825. The dive profiles referred to here are those described in R. W. Hamilton, et.al., "Development and validation of no-stop decompression procedures for recreational diving: The DSAT Recreational Dive Planner". DSAT, Inc. and Hamilton Research Ltd., 1994 ("Hamilton"), the contents of which are incorporated herein by reference.

FIGS. 7A to 7J show examples of significant differences between the 3CM model predictions and those of some PC-based models, where either empirical or other evidence are more consistent with the 3CM predictions. Unless otherwise stated, the descent and ascent rates for all the examples given are 60 fsw/min.

Figure 7A:
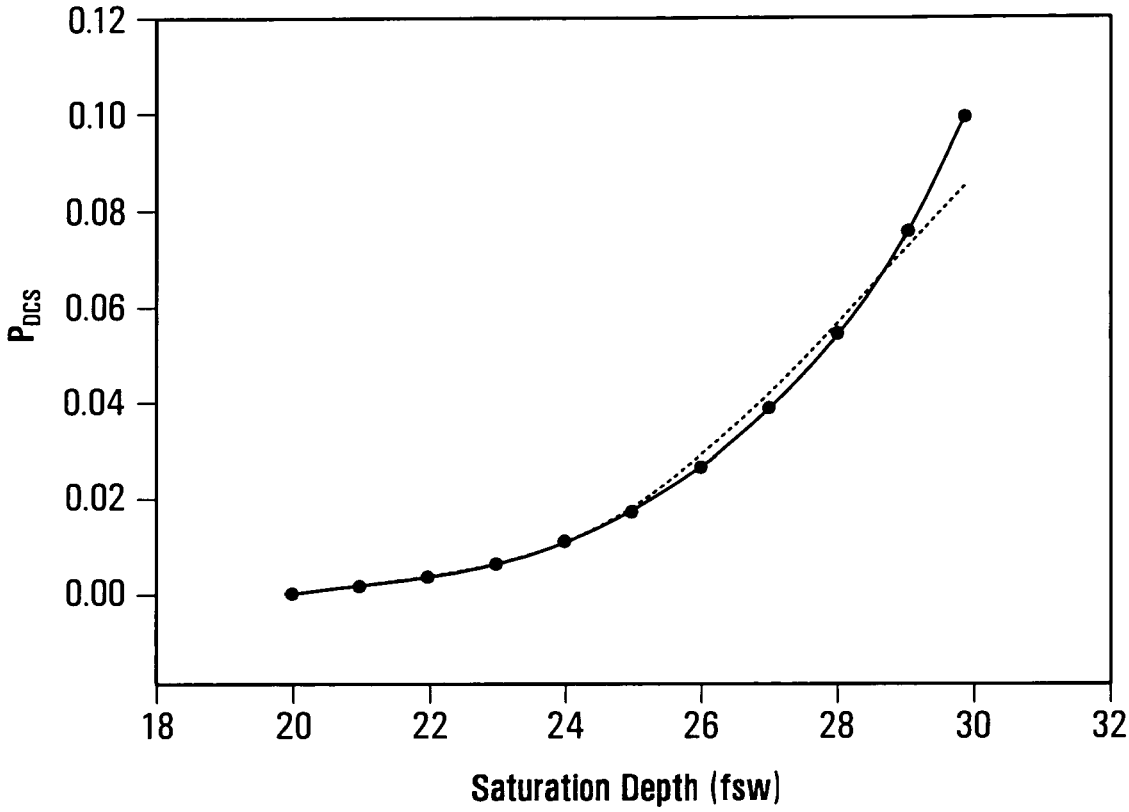
FIGS. 7A to 7J are graphs showing calculated probabilities of decompression sickness.

FIG. 7A shows fits of a 3CM model (solid line) and a 2PC model (dashed line) to points of a Weibull function (solid circles) in the low-risk regime ($0.1\%<P_{DCS}<10\%$). A conventional risk function was used in the 2PC model, which is described in Tikuisis I, supra. As in the 3CM model, the 2PC model also has four fitted parameters. Thus, both models have the same number of degrees of freedom. However, as can be seen from the results shown in FIG. 7A, the 3CM model fits the Weibull function points much better than does the 2PC model. Studies also showed that fitting with a 3PC model did not significantly improve the goodness of fit relative to the 2PC model fit.

Figure 7B:
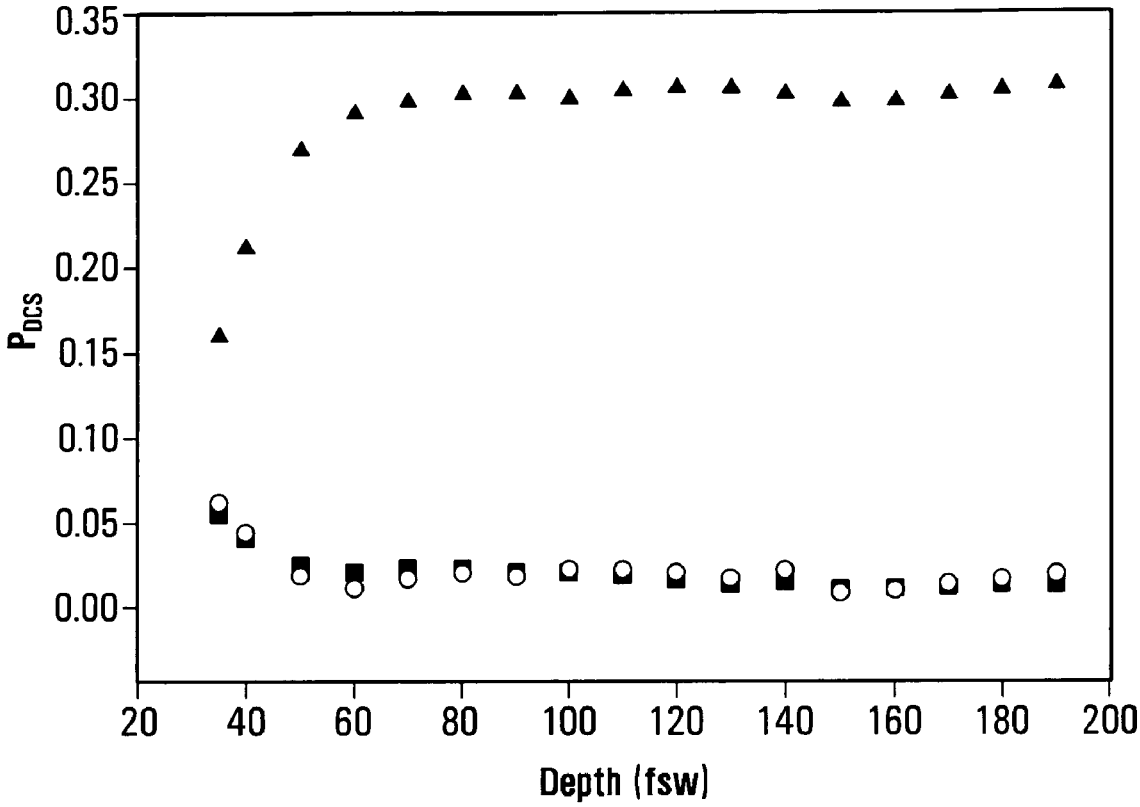

FIG. 7B shows a comparison of probability of DCS at the NDL for "bounce" dives predicted by USN93D (solid squares), 3CM (circles) and 2PC (triangles) models, in the low risk regime. The USN93D predicted values shown are taken from Tikuisis II, supra, p. 449. The parameter values for both the 3CM and 2PC models were obtained by fitting the models to the saturation data described above. The USN93D model is generally considered accurate for this type of dive profile. As can be seen, the 3CM model projections are much more consistent with the USN93D model values than are the 2PC model projections, indicating that the 3CM model can more accurately "project" from saturation dives to bounce dives than can the 2PC model.

Figure 7C:
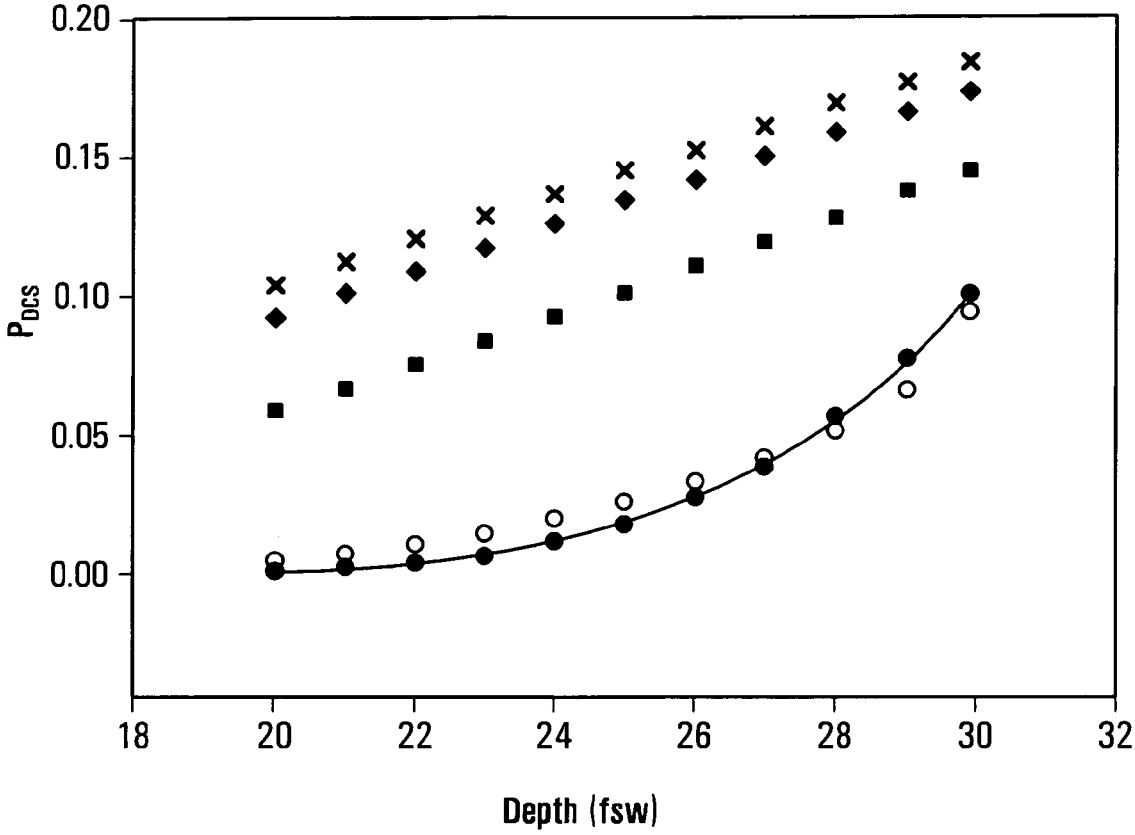

FIG. 7C shows a comparison of risk predictions of a 3CM model (open circles), a 3PC model (solid squares), an LE model (solid diamonds), and an EE model (crosses), as well as the observed human saturation data as expressed in the Weibull function (solid circles and the curved line). The LE and EE models are described in Thalmann II, supra, but are referred to therein as LEI and EEI respectively. For comparison purposes, the 3CM model was calibrated in this case against the USN93D predicted values for bounce dives, and the parameter values are respectively, $f_c=1.029$, $f_a=3.13$, $f_b=0.00936$, and $c=0.311$ (all in unit of 1/min). As can be seen, the 3CM predictions are much more consistent with the observed data than any of the comparison models, indicating that the 3CM model can also more accurately "project" from bounce dives to saturation dives.

Figure 7D:
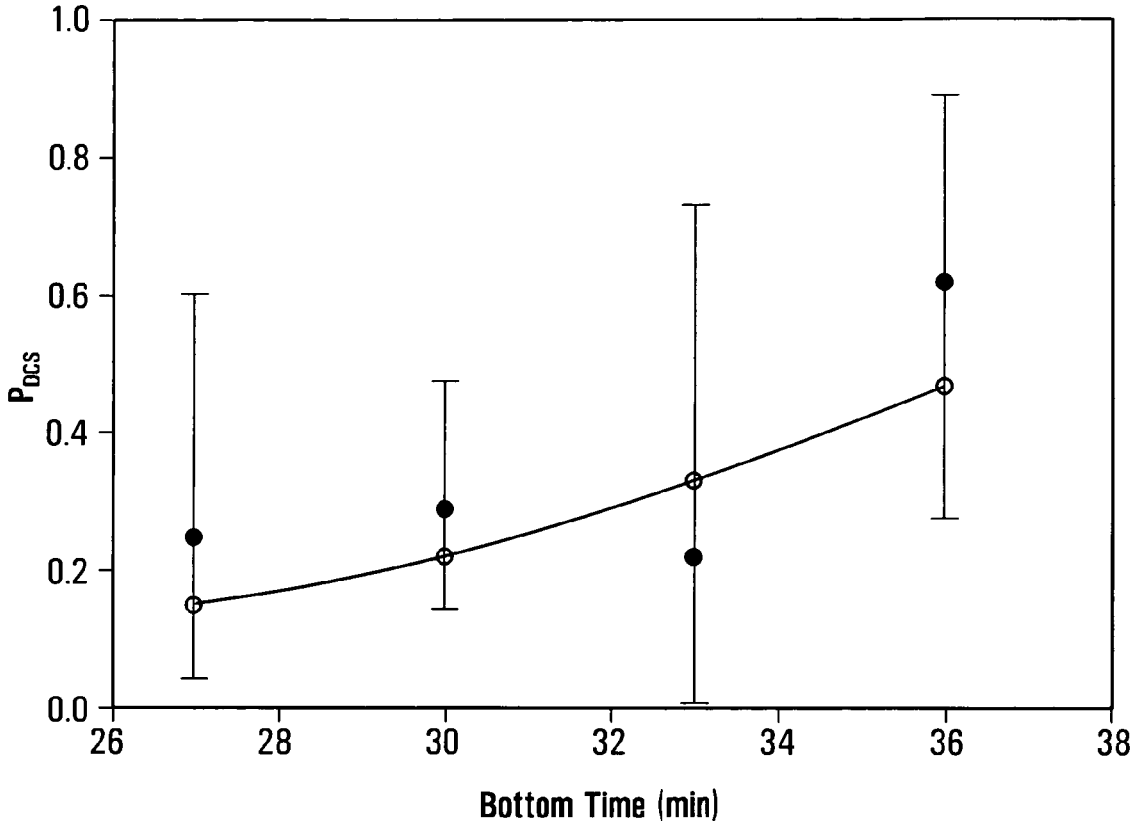

FIG. 7D shows a comparison of data points (solid circles) in the USN EDU849LT2 dataset and predictions based on a 3CM model (open circles). The error bars shown represent 95% binomial confidence intervals. The dataset is provided in Temple, supra, vol. 1, Section 1, part G, and includes high risk, no-stop, square dive profiles, at a depth of 150 fsw. The 3CM model was calibrated against saturation dive profiles that included high risk dive profiles. As can be seen, the 3CM model also projected well from saturation to bounce profiles in the high risk regime.

Figure 7E:
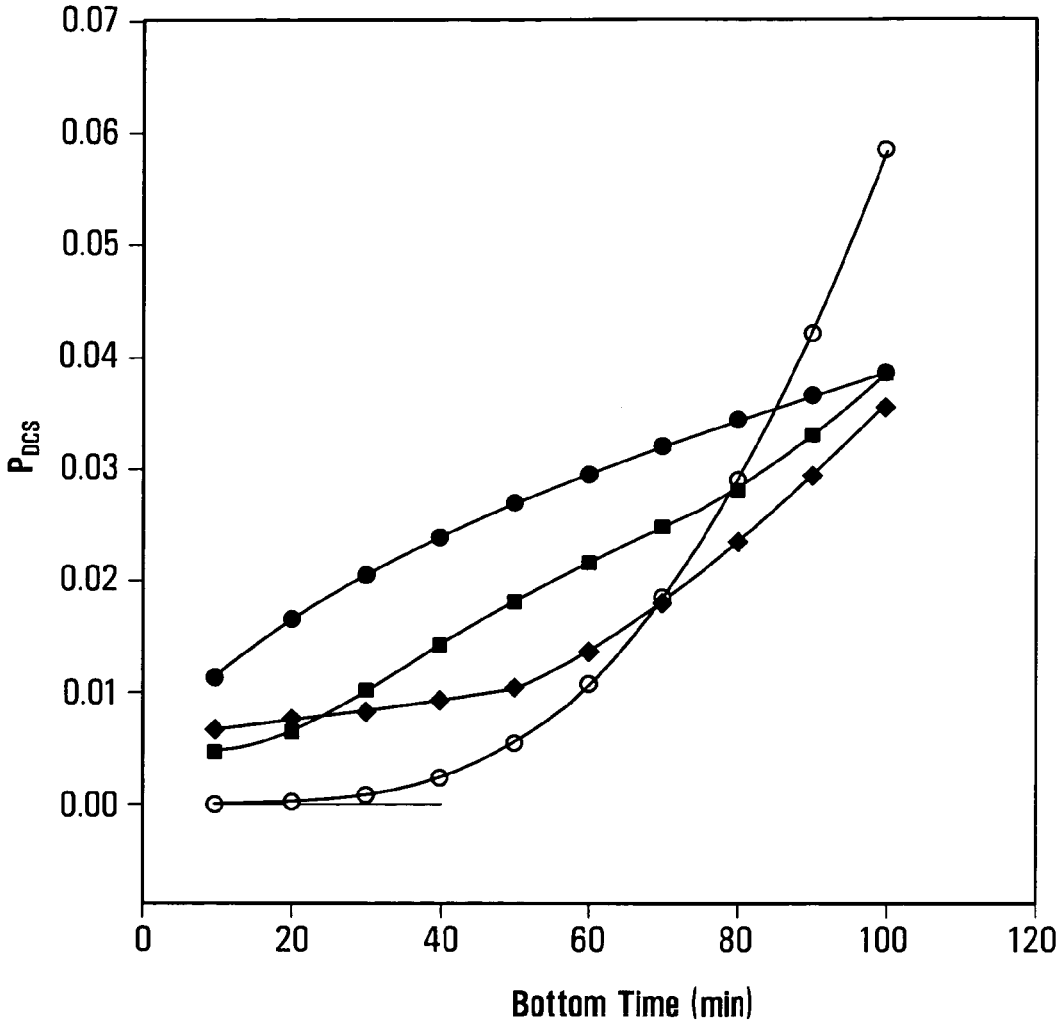

FIG. 7E shows a comparison of predictions based on 3CM (open circles), 3CP (solid squares), and LE (solid diamonds) models for no-stop bounce dives to 60 fsw with various bottom times. The solid circles represent points calculated according to the product of bottom depth and the square root of bottom time. An empirical risk estimate (the level line at about 0.0002) is also shown, which is reported in B. C. Gilliam, "Evaluation of Decompression Sickness Incidence in Multi-Day Repetitive Diving for 77,680 Sport Dives", in M. A. Lang and R. D. Vann eds., *Proceedings of Repetitive Diving Workshop*, AAUSDSP-RDW-02-92, Costa Mesa, Calif.: American Academy of Underwater Sciences, 1992, p. 15, the contents of which are incorporated herein by reference. As can be seen, the 3CM predictions are more consistent with the empirical estimate at short bottom times (such as less than about 30 minutes) than the other predictions. On the other hand, for long bottom times the 3CM model predicts a more rapid rise of the probability of DCS than do the other models.

Figure 7F:
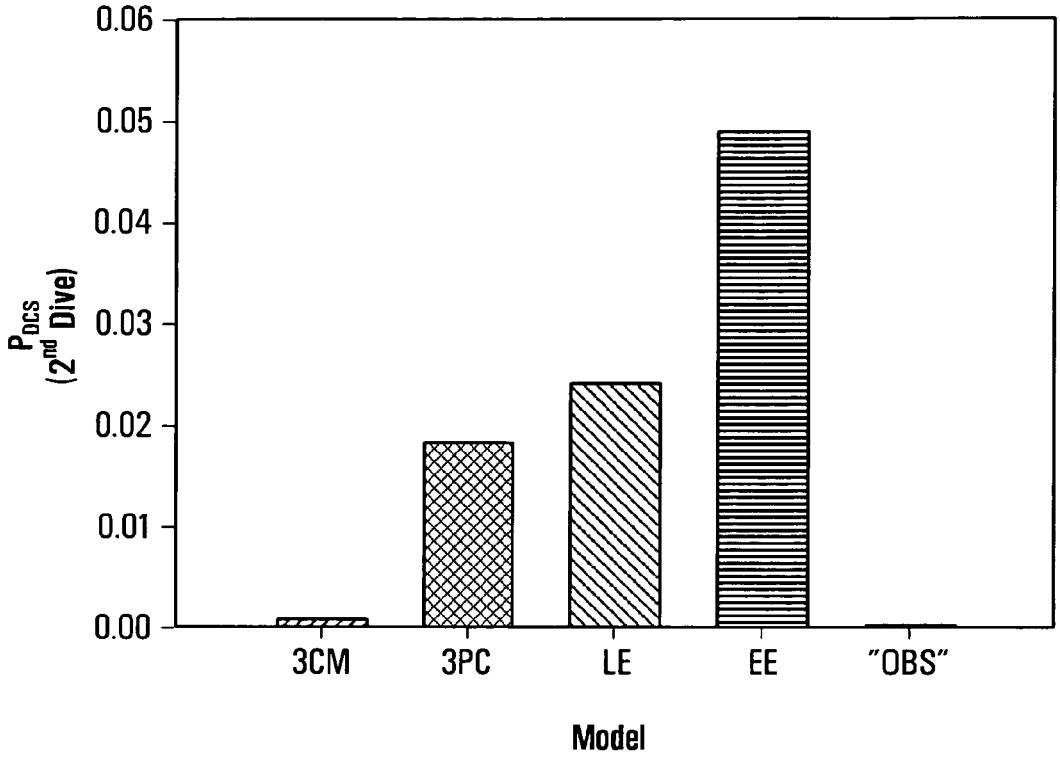

FIG. 7F is a bar graph showing a comparison of predictions based on different models for a repetitive, low-risk dive profile, which is of a kind commonly carried out from shore-based dive-boat operations, where the divers dive conservatively. The dive profile used consists of two dives. The first dive is to a bottom depth of 60 fsw with a bottom time of 55 minutes, a safety stop at 15 fsw for 3 minutes, and a surface interval of 60 minutes. The second dive is to a bottom depth of 50 fsw for a bottom time of 50 minutes, followed by a safety stop at 15 fsw for 3 minutes. The predicted risks of DCS shown are for the second dive. The bar marked "OBS" has a height of about 0.0002, indicating the empirical estimate discussed above. The predicted probability of DCS based on the 3CM model is about 0.00077, which is of the same order-of-magnitude as the empirical estimate. The other predictions are some two orders-of-magnitude higher.

Figure 7G:
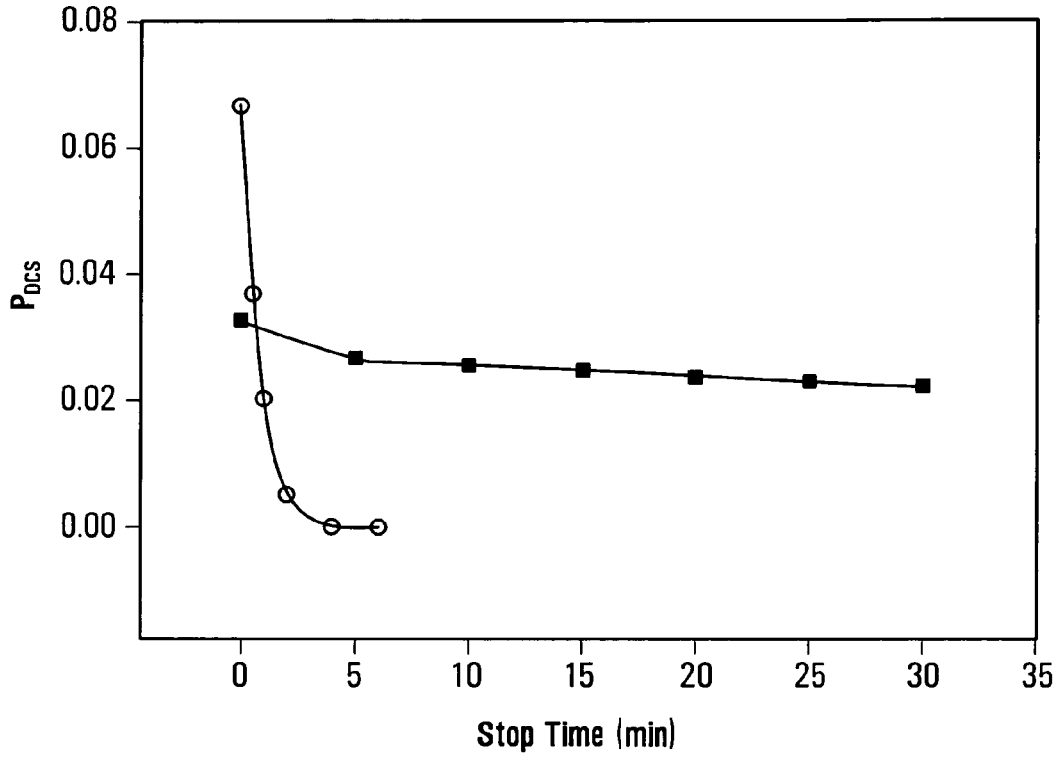

FIG. 7G shows predictions of the probability of DCS as a function of stop time for a single dive that requires a decompression stop. The predictions are for the dive carried out under the constraint of a single stop depth. The results shown are based on a 3CM model (open circles) and a 3CP model (solid squares). The dive profile has a single stop after 30 minutes of bottom time at a depth of 120 fsw. The stop is at the depth of 15 fsw for the 3CM model and the depth of 25 fsw for the 3PC model, which are respectively the optimized stop depths for each model, in the sense that, in each case, the stop depth used is the most effective single-stop depth. As can be appreciated, zero stop time effectively means no-stop. As can be seen, in the absence of a stop the 3CM model predicts a probability of DCS about twice as large as that predicted by the 3PC model. According to the predictions based on the 3CM model, the probability of DCS is reduced with a stop at the optimized depth, down to about zero when the stop time is about 7 minutes. In comparison, the rate of reduction in the probability of DCS predicted by the 3PC model is less, with the probability of DCS still above 0.02 when the stop time is up to about 30 minutes.

Figure 7H:
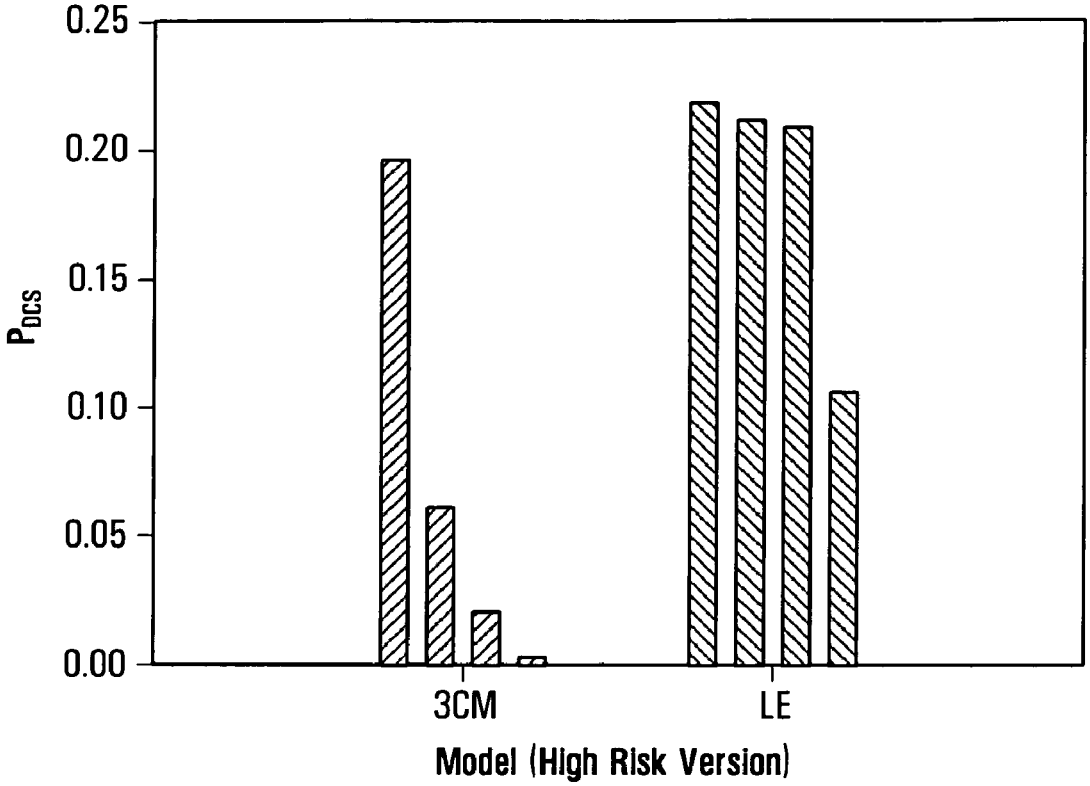

FIG. 7H shows a comparison of predictions based on a 3CM model and an LE model for high-risk dives. The dives are deep bounce dives with a bottom depth of 250 fsw and bottom time of 10 minutes. For each model, the four dive profiles respectively (from left to right) have: no stop; one stop, at 15 fsw for 3 minutes; two stops, the first stop at 80 fsw for one minute and the second stop at 15 fsw for 3 minutes; three stops, the first stop at 80 fsw for 1 minute, the second stop at 40 fsw for 20 minutes, and the third stop at 15 fsw for 3 minutes. In this case, the descent rate used was 100 fsw/min and the ascent rate was 60 fsw/min. The LE model used is similar to that reported by R. Ball et al., "Predicting risk of decompression sickness in humans from outcomes in sheep", *Journal of Applied Physiology,* 1999, vol. 86, pp. 1920-1929, ("Ball"). As can be seen, the predicted probabilities of DCS are similar for the no-stop dives but much lower probabilities are predicted by the 3CM model when there are one or more stops. Further, as can be seen, the different types of stops shown all have a significant effect on the probability of DCS predicted by the 3CM model.

Figure 7I:
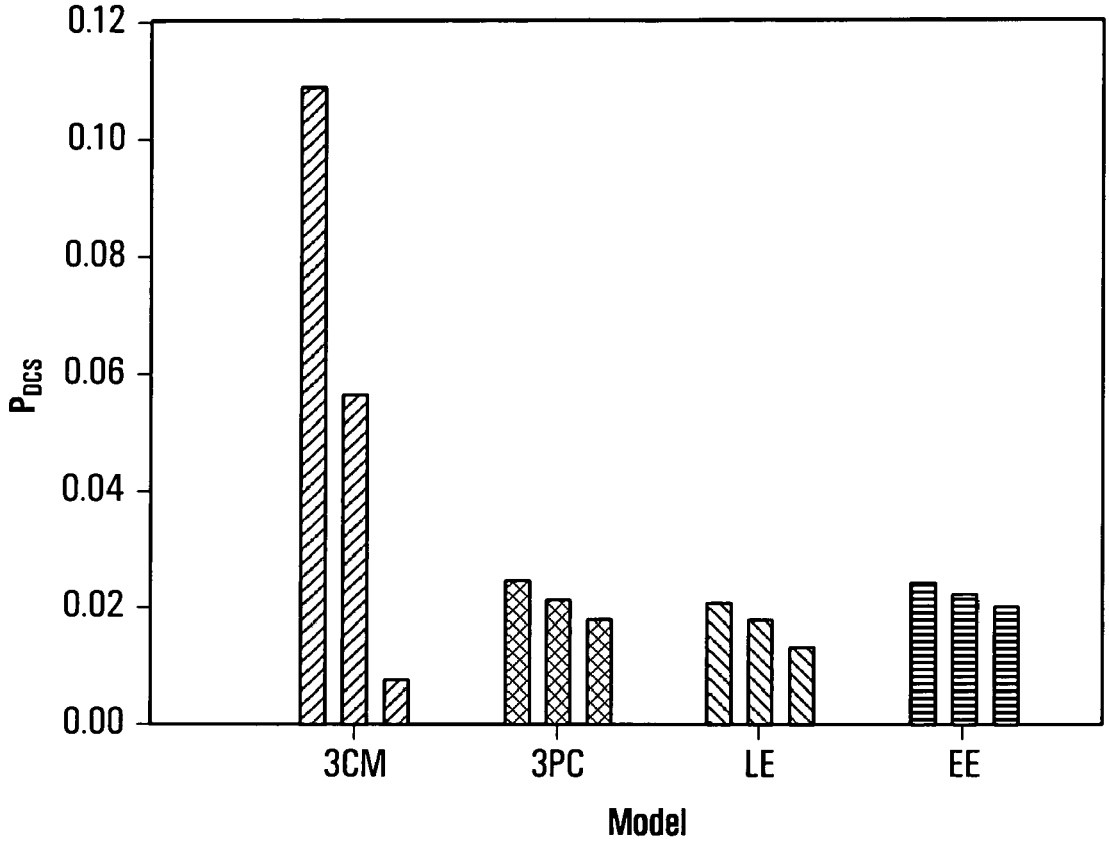

FIG. 7I shows the predictions of the probability of DCS based on different models for no-stop, square profile dives. All the profiles include a deep bounce dive to a bottom depth of 190 fsw with a bottom time of 10 minutes. The descent rate is always 60 fsw/min. For each model, predictions for three dive profiles are shown. The three profiles for each model have ascent rates of 100, 60 and 30 fsw/min respectively (from left to right). As shown, the 3CM model predicts a significant reduction in the probability of DCS when the ascent rate is reduced, by a factor of about two from 100 fsw/min to 60 fsw/min and more than a factor of five from 60 fsw/min to 30 fsw/min. In comparison, all the other models predict a much smaller reduction in the probability of DCS when the ascent rate is reduced.

Figure 7J:
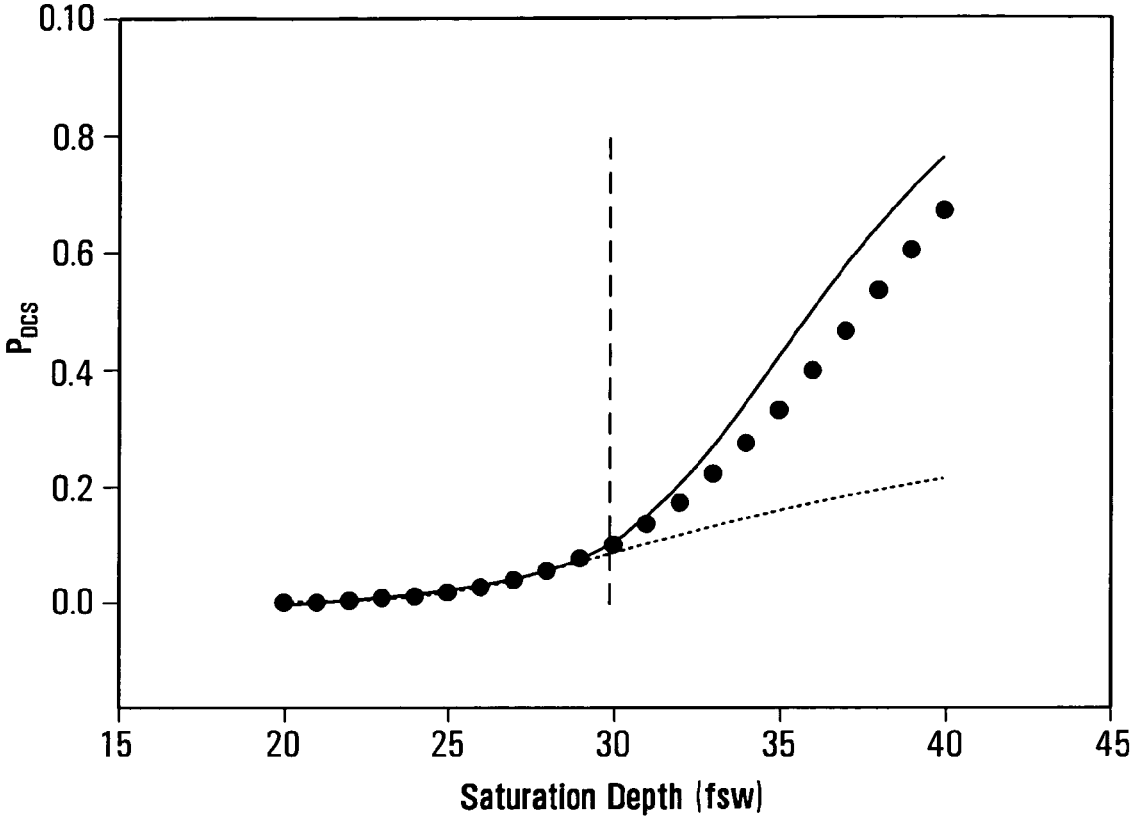

FIG. 7J shows a comparison of predictions based on a 3CM model (solid line) and a 2PC model (dotted line). The empirical data (solid circles) shown are points from a Weibull function for square saturation dives. Both models were calibrated against low risk data (with saturation depths below the depth of 30 fsw, indicated by the vertical dashed line). As can be seen, the 3CM predictions are closer to the empirical data than the 2PC predictions in the higher risk regimes, where the saturation depths are from 30 up to 40 fsw.

Therefore, as can be appreciated, using an embodiment of the present invention disclosed herein, more accurate predictions relating to decompression sickness may be obtained for a wide range of dive profiles, as compared to conventional decompression models. Consequently, safer dive practices may be developed for many types of dives, and unnecessary safety precautions may be avoided for others.

Modifications to the gas distribution model and to the different calibration datasets may be made to adapt an embodiment of the present invention for use in specific applications, including: submarine escape; "Yo-Yo" diving as described by R. W. Hamilton and E. D. Thalmann in *Bennett and Elliott's Physiology And Medicine of Diving,* $5^{th}$ edition, Philadelphia, W. B. Saunders, 2003, Chapter 10.2, p. 459, the contents of which are incorporated herein by reference; prediction of the time of onset of DCS symptoms as described such as in Thalmann, supra; prediction of the form and severity of DCS as discussed, for example, in Tikuisis II, supra; assessing the influence of exercise and ambient temperature on the prediction of $P_{DCS}$ as discussed, for example, by R. W. Hamilton, supra, and the like.

While in-water decompression and safety stop schedules with air as the breathing mixture have been mainly discussed above, the embodiments described herein can be readily modified for use in other types of decompression procedures including breathing gas switches during underwater decompression, surface-decompression procedures, decompression procedures for "bell diving", and "underwater habitat" diving, as can be understood by persons skilled in the art. For instance, the decompression times and pressures for dry-chamber decompression using any selected breathing mixture(s) may be determined using a compartmental mammillary system such as system 10.

Further, the embodiments described herein may also be modified for use in applications requiring inert gas decompression other than diving applications. For example, workers subjected to compressed air exposure, such as in tunnel and caisson work, may require decompression therapy. Other possible applications in which interconnected compartmental models with inert gas sinks and sources may be incorporated include medical applications such as decompression therapy, applications related to aviation and space travel, and the like. For instance, the 3CM model may be used in high altitude flying or space travel to predict the risk of decompression sickness due to a drop in ambient pressure at high altitudes or in space. In those cases, a person is exposed to an environment that includes an inert gas and the ambient pressure varies during the exposure. As may be appreciated by those skilled in the art, in these decompression situations a variety of biological processes, in addition to inert gas gradients, may play a significant role, to such a degree that DCS, if it occurs, is of a different nature than in hyperbaric decompressions. Nevertheless, the exposure to a breathing mixture in these and similar applications can be represented with an exposure profile similar to a dive profile. The risk of decompression sickness for the exposure profile can be assessed as for a dive profile using an interconnected compartmental model with inert gas sources and sinks, with possible additional considerations and some variations as considered appropriate by one skilled in the art.

Other features, benefits and advantages of the embodiments described herein not expressly mentioned above can be understood from this description and the drawings by those skilled in the art.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A method for predicting risks of decompression sickness, comprising:

providing a mathematical model that models gas exchange of a central compartment with an environment having a model gas at a modeled environmental pressure ($P_e$), said central compartment modeled to be in direct fluid communication with a plurality of peripheral compartments and with said environment to exchange said model gas therewith, said model comprising a plurality of prescribed parameters such that a pressure of said model gas in each one of said compartments can be calculated using said model; and for a period of exposure of a person to a breathing mixture comprising an inert gas, obtaining an ambient pressure ($P_a$) of said breathing mixture during said period;

determining an ambient partial pressure ($P_{a,n}$) of said inert gas in said breathing mixture during said period;

calculating a pressure ($P_{cc}$) of said model gas in said central compartment, using said model with $P_e=P_{a,n}$;

calculating a risk of decompression sickness to said person after exposure to said breathing mixture for said period, from $P_a$, $P_{a,n}$ and $P_{cc}$, wherein values of said prescribed parameters are calibrated so that said risk of decompression sickness is representative of actual risk of decompression sickness to said person after said exposure;

deriving information related to decompression from said risk of decompression sickness; and outputting said information related to decompression.

2. The method of claim 1, wherein said plurality of peripheral compartments comprise two peripheral compartments.

3. The method of claim 2, wherein said central and peripheral compartments form a compartmental mammillary system.

4. The method of claim 3, wherein each one of said peripheral compartments is modeled to be in direct fluid communication with said central compartment only.

5. The method of claim 4, wherein said plurality of prescribed parameters comprise fractional transfer coefficients $f_a$, $f_b$ and $f_c$, $f_a$ for gas transfer from a first one of said two peripheral compartments to said central compartment, $f_b$ for gas transfer from a second one of said two peripheral compartments to said central compartment, $f_c$ for gas transfer from said environment to said central compartment and for gas transfer from said central compartment to, respectively, each one of said environment and said first and second peripheral compartments.

6. The method of claim 1, wherein values of said prescribed parameters are determined by calibrating said model against empirical data related to decompression sickness incidence rates.

7. The method of claim 6, wherein said empirical data comprises observed occurrences of decompression sickness in humans after saturation dives.

8. The method of claim 1, wherein said period of exposure comprises a decompression period from time $t_s$ time $t_e$, said calculating a risk of decompression sickness comprising calculating a probability of decompression sickness ($P_{DCS}$), wherein $$P_{DCS}=1-\exp[-R(t_s-t_e)],$$

where $R(t_s-t_e)=\int_s^e(t)dt$, and r(t) is an instantaneous decompression risk per unit time at t dependent on $P_a$, $P_{a,n}$ and $P_{cc}$.

9. The method of claim 8, further comprising:

representing said exposure with an exposure profile consisting of a plurality of linear segments, said linear segments comprising at least one decompression segment; and for each one of said at least one decompression segment, determining a cumulative decompression risk;

wherein $R(t_s-t_e)$ is calculated as a sum of said cumulative decompression risks.

10. The method of claim 8, wherein $r(t)=c\Delta P\ (1+\Delta P)$ when $\Delta P\geqq 0$, and $r(t)=0$ when $\Delta P<0$, where $\Delta P=(P_{cc}-P_a-P_{th})P_a^{\ m}/P_u^{\ m+1}$, c being a constant, $P_{th}$ being a threshold pressure dependent on at least $P_{a,n}$, $P_u$ being a unit pressure, m being a constant.

11. The method of claim 10, wherein $P_{th}=P_{a,n}[\alpha-\exp(-\beta/P_a)]-P_a$, α and β being constants.

12. The method of claim 11, wherein m=2, α=2.158, β=0.322 atm, and $P_u$=1 atm.

13. The method of claim 12, wherein said plurality of prescribed parameters comprise fractional transfer coefficients $f_a$, $f_b$ and $f_c$, $f_a$ for gas transfer from a first one of said peripheral compartments to said central compartment, $f_b$ for gas transfer from a second one of said peripheral compartments to said central compartment, $f_c$ for gas transfer from said environment to said central compartment and for gas transfer from said central compartment to, respectively, each one of said environment and said first and second peripheral compartments.

14. The method of claim 13, wherein the values of c, $f_c$, $f_a$ and $f_b$ are selected from first, second and third sets of values, said first set consisting of a value of about 0.260 $min^{-1}$ for c, a value of about 2.11 $min^{-1}$ for $f_c$, a value of about 0.73 $min^{-1}$ for $f_a$, and a value of about 0.0100 $min^{-1}$ for $f_b$; said second set consisting of a value of about 0.252 $min^{-1}$ for c, a value of about 2.09 $min^{-1}$ for $f_c$, a value of about 0.69 $min^{-1}$ for $f_a$, and a value of about 0.0127 $min^{-1}$ for $f_b$; said third set consisting of a value of about 0.252 $min^{-1}$ for c, a value of about 2.09 $min^{-1}$ for $f_c$, a value of about 0.68 $min^{-1}$ for $f_a$, and a value of about 0.0148 $min^{-1}$ for $f_b$.

15. The method of claim 14, wherein said period of exposure comprises a period in a dive, and c, $f_c$, $f_a$ and $f_b$ respectively have (i) said first set of values, when said dive has an expected probability of decompression sickness below 0.10, or (ii) said second set of values, when said expected probability is from 0.10 to 0.135, or (iii) said third set of values, when said expected probability is above 0.135.

16. The method of claim 8, wherein r(t) is a function of a modeled measure of at least one of a degree of supersaturation and an extent of bubble formation in said central compartment, said measure being dependent on $P_a$, $P_{a,n}$ and $P_{cc}$.

17. A method comprising receiving data indicative of a period of exposure of a person to a breathing mixture comprising an inert gas; and obtaining information derived from a risk of decompression sickness to said person after said period of exposure, said risk determined according to the method of claim 1.

18. The method of claim 17, wherein said information comprises said risk.

19. The method of claim 17, wherein said risk is retrievably pre-stored, in association with exposure data indicative of said exposure.

20. The method of claim 17, wherein said information is retrievably pre-stored, in association with exposure data indicative of said exposure.

21. A computing device comprising:

a processor;

a memory storing computer executable instructions, said instructions, when executed by said processor, cause said processor to:

for a period of exposure of a person to a breathing mixture comprising an inert gas, obtain an ambient pressure ($P_a$) of said breathing mixture during said period;

determine an ambient partial pressure ($P_{a,n}$) of said inert gas in said breathing mixture during said period;

calculate a pressure ($P_{cc}$), according to a mathematical model that models gas exchange of a central compartment with an environment having a model gas at a modeled environmental pressure ($P_e$), said central compartment modeled to be in direct fluid communication with a plurality of peripheral compartments and with said environment to exchange said model gas therewith, said model comprising a plurality of prescribed parameters such that a pressure of said model gas in each one of said compartments can be calculated using said model, wherein $P_{cc}$ is the pressure of said model gas in said central compartment and $P_e=P_{a,n}$; and calculate a risk of decompression sickness to said person after exposure to said breathing mixture for said period, from $P_a$, $P_{a,n}$ and $P_{cc}$, wherein values of said prescribed parameters are calibrated so that said risk of decompression sickness is representative of actual risk of decompression sickness to said person after said period of exposure; and derive information related to decompression from said risk of decompression sickness; and an output in communication with said processor for displaying said information related to decompression.

22. The computing device of claim 21, wherein said plurality of peripheral compartments comprise two peripheral compartments.

23. The computing device of claim 22, wherein said central and peripheral compartments form a compartmental mammillary system.

24. The computing device of claim 23, wherein each one of said peripheral compartments is modeled to be in direct fluid communication with said central compartment only.

25. The computing device of claim 24, wherein said plurality of prescribed parameters comprise fractional transfer coefficients $f_a$, $f_b$ and $f_c$, $f_a$ for gas transfer from a first one of said two peripheral compartments to said central compartment, $f_b$ for gas transfer from a second one of said two peripheral compartments to said central compartment, $f_c$ for gas transfer from said environment to said central compartment and for gas transfer from said central compartment to, respectively, each one of said environment and said first and second peripheral compartments.

26. The computing device of claim 21, wherein values of said prescribed parameters are determined by calibrating said model against empirical data related to decompression sickness incidence rates.

27. The computing device of claim 26, wherein said empirical data comprises observed occurrences of decompression sickness for humans after saturation dives.

28. The computing device of claim 21, wherein said period of exposure comprises a decompression period from time $t_s$ to time $t_e$, said risk of decompression sickness being calculated as a probability of decompression sickness ($P_{DCS}$) according to $$P_{DCS}=1-\exp[-R(t_s-t_e)],$$

where $R(t_s-t_e)=\int_s^e r(t)dt$, and r(t) is an instantaneous decompression risk per unit time dependent on $P_a$, $P_{a,n}$ and $P_{cc}$.

29. The computing device of claim 28, wherein $R(t_s-t_e)$ is calculated by:

representing said exposure with an exposure profile consisting of a plurality of linear segments, said linear segments comprising at least one decompression segment;

for each one of said at least one decompression segment, calculating a cumulative decompression risk; and summing said cumulative decompression risks.

30. The computing device of claim 29, wherein $P_{th}=P_{a,n}[\alpha-\exp(-\beta/P_a)]-P_a$, α and β being constants.

31. The computing device of claim 30, wherein m=2, α=2.158, β=0.322 atm, and $P_u$=1 atm.

32. The computing device of claim 31, wherein said plurality of prescribed parameters comprise fractional transfer coefficients $f_a$, $f_b$ and $f_c$, $f_a$ for gas transfer from a first one of said peripheral compartments to said central compartment, $f_b$ for gas transfer from a second one of said peripheral compartments to said central compartment, $f_c$ for gas transfer from said environment to said central compartment and for gas transfer from said central compartment to, respectively, each one of said environment and said first and second peripheral compartments.

33. The computing device of claim 32, wherein the values of c, $f_c$, $f_a$ and $f_b$ are selected from first, second and third sets of values, said first set consisting of a value of about 0.260 $min^{-1}$ for c, a value of about 2.11 $min^{-1}$ for $f_c$, a value of about 0.73 $min^{-1}$ for $f_a$, and a value of about 0.0100 $min^{-}$for $f_b$; said second set consisting of a value of about 0.252 $min^{-1}$ for c, a value of about 2.09 $min^{-1}$ for $f_c$, a value of about 0.69 $min^{-1}$ for $f_a$, and a value of about 0.0127 $min^{-1}$ for $f_b$; said third set consisting of a value of about 0.252 $min^{-1}$ for c, a value of about 2.09 $min^{-1}$ for $f_c$, a value of about 0.68 $min^{-1}$ for $f_a$, and a value of about 0.0148 $min^{-1}$ for $f_b$.

34. The computing device of claim 33, wherein said period of exposure comprises a period in a dive, and c, , $f_c$, $f_a$ and $f_b$ respectively have (i) said first set of values, when said dive has an expected probability of decompression sickness below 0.10, or (ii) said second set of values, when said expected probability is from 0.10 to 0.135, or (iii) said third set of values, when said expected probability is above 0.135.

35. The computing device of claim 28, wherein $r(t)=c\Delta P\ (1+\Delta P)$ when $\Delta P\geqq 0$, and $r(t)=0$ when $\Delta P<0$, where $\Delta P=(P_{cc}-P_a-P_{th})\ P_a^{\ m}/P_u^{\ m+1}$, c being a constant, $P_{th}$ being a threshold pressure dependent at least on $P_{a,n}$, $P_u$ being a unit pressure, m being a constant.

36. The computing device of claim 28, wherein r(t) is a function of a modeled measure of at least one of a degree of supersaturation and an extent of bubble formation in said central compartment, said measure being dependent on $P_a$, $P_{a,n}$ and $P_{cc}$.

37. The computing device of claim 21, which is a dive computer for underwater use, said dive computer further comprising:

a time piece, in communication with said processor, for tracking time and for generating a signal indicative of current time; and an input, in communication with said processor, for receiving a signal indicative of a hydrostatic ambient pressure.

38. The computing device of claim 37, wherein said information related to decompression comprises data indicative of a no-stop decompression limit (NDL) for a dive.

39. The computing device of claim 37, wherein said information related to decompression comprises a decompression schedule.

40. The computing device of claim 37, wherein said input comprises a sensor for detecting a signal indicative of said hydrostatic ambient pressure.

41. A computer readable medium storing thereon the computer executable instructions of claim 21.

42. The computer readable medium of claim 41, wherein said plurality of peripheral compartments comprise two peripheral compartments and said central and peripheral compartments form a compartmental mammillary system.

43. A method of predicting risks of decompression sickness of a person, comprising:

providing a mathematical model that models exchange of a model gas between a central compartment and the environment, said central compartment modeled to be in direct fluid communication with a plurality of peripheral compartments and with said environment to exchange said model gas therewith, said model allowing calculation of a measure of an amount of said model gas in said central compartment for a given measure of an amount of said model gas in said environment over a given time period;

obtaining a measure of an amount of an inert gas in a breathing mixture over a period of exposure of said person to said breathing mixture;

using, in said model, said measure of said amount of said inert gas over said period of exposure as said given measure of said amount of said model gas in said environment over said given time period, and calculating said measure of said amount of said model gas in said central compartment according to said model;

calculating a risk of decompression sickness to said person resulting from said exposure, based on said calculated measure of said amount of said model gas in said central compartment;

deriving information related to decompression from said risk of decompression sickness; and outputting said information related to decompression.

44. The method of claim 43, wherein said plurality of peripheral compartments comprise two peripheral compartments.

45. The method of claim 43, wherein said central and peripheral compartments form a compartmental mammillary system.

46. The method of claim 43, wherein each one of said peripheral compartments is modeled to be in direct fluid communication with said central compartment only.

* * * * *

UNITED STATES PATENT AND TRADEMARK OFFICE

CERTIFICATE OF CORRECTION

PATENT NO. : 7,474,981 B2 
APPLICATION NO. : 11/369470
DATED : January 6, 2009
INVENTOR(S) : Saul Goldman It is certified that error appears in the above-identified patent and that said Letters Patent is hereby corrected as shown below:

In claim 8, line 30 col. 33, " $\int_{s}^{e}(t)dt$ " should appear as follows: -- $\int_{t_s}^{t_e} r(t)dt$ --.

In claim 28, line 30 col. 35, " $\int_{s}^{e} r(t)dt$ " should appear as follows: -- $\int_{t_s}^{t_e} r(t)dt$ --.

In claim 29, lines 33-40 col. 35, cancel the text beginning with "29. The computing device" to and ending with "cumulative decompression risks." and insert the following claim:

--29. The computing device of claim 28, wherein
$r(t) = c\,\Delta P\,(1+\Delta P)$ when $\Delta P \geq 0$, and $r(t) = 0$ when $\Delta P < 0$,
where $\Delta P = (P_{cc} - P_a - P_{th})\ P_a^{\,m}/P_u^{\,m+1}$, $c$ being a constant, $P_{th}$ being a threshold pressure dependent at least on $P_{a,n}$, $P_u$ being a unit pressure, $m$ being a constant.--.

In claim 33, line 59 col. 35, "min$^{-}$ for $f_b$"should read --min$^{-1}$ for $f_b$--.

In claim 34, line 67 col. 35, "c, , $f_c$" should read --c, $f_c$--.

In claim 35, line 6-12 col. 36, cancel the text beginning with "35. The computing device" to and ending "being a constant." and insert the following claim:

--35. The computing device of claim 28, wherein $R(t_s\text{-}t_e)$ is calculated by: representing said exposure with an exposure profile consisting of a plurality of linear segments, said linear segments comprising at least one decompression segment;

UNITED STATES PATENT AND TRADEMARK OFFICE

CERTIFICATE OF CORRECTION

PATENT NO. : 7,474,981 B2
APPLICATION NO. : 11/369470
DATED : January 6, 2009
INVENTOR(S) : Saul Goldman It is certified that error appears in the above-identified patent and that said Letters Patent is hereby corrected as shown below:

for each one of said at least one decompression segment, calculating a cumulative decompression risk; and
summing said cumulative decompression risks.--.

Signed and Sealed this

Twenty-fourth Day of November, 2009

David J. Kappos

David J. Kappos
*Director of the United States Patent and Trademark Office*